US006001525A

United States Patent [19]

Ida et al.

[11] Patent Number: 6,001,525

[45] Date of Patent: Dec. 14, 1999

[54] ELECTROPHOTOGRAPHIC DEVELOPER CARRIER, TWO-COMPONENT TYPE DEVELOPER AND IMAGE FORMING METHOD

[75] Inventors: Tetsuya Ida; Masaaki Taya, both of Mishima; Makoto Kanbayashi, Suntoh-gun, all of Japan

[73] Assignee: Canon Kabushiki Kaisha, Tokyo, Japan

[21] Appl. No.: 08/974,728

[22] Filed: Nov. 19, 1997

[30] Foreign Application Priority Data

Nov. 19, 1996 [JP] Japan ..... 8-307712
Feb. 28, 1997 [JP] Japan ..... 9-045751

[51] Int. Cl.[6] ..... G03G 9/113

[52] U.S. Cl. ..... 430/106.6; 430/108; 430/122

[58] Field of Search ..... 430/106.6, 108, 430/122

[56] References Cited

U.S. PATENT DOCUMENTS

| | | | |
|---|---|---|---|
| 2,221,776 | 11/1940 | Carlson | 95/5 |
| 2,297,691 | 10/1942 | Carlson | 95/5 |
| 2,618,552 | 11/1952 | Wise | 95/1.9 |
| 2,874,063 | 2/1959 | Grieg | 117/17.5 |
| 3,666,363 | 5/1972 | Tanaka et al. | 355/17 |
| 3,909,258 | 9/1975 | Kotz | 96/1 R |
| 4,071,361 | 1/1978 | Marushima | 96/1.4 |
| 5,330,871 | 7/1994 | Tanikawa et al. | 430/110 |
| 5,368,969 | 11/1994 | Yoshikawa et al. | 430/108 |
| 5,418,102 | 5/1995 | Kotaki et al. | 430/109 |
| 5,665,513 | 9/1997 | Ida et al. | 430/110 |
| 5,731,120 | 3/1998 | Tanigami et al. | 430/108 |

FOREIGN PATENT DOCUMENTS

| | | |
|---|---|---|
| 0351712 | 1/1990 | European Pat. Off. . |
| 0617338 | 9/1994 | European Pat. Off. . |
| 0647887 | 4/1995 | European Pat. Off. . |
| 4323806 | 1/1994 | Germany . |
| 55-157751 | 12/1980 | Japan . |
| 62-63970 | 3/1987 | Japan . |
| 1-147478 | 6/1989 | Japan . |

OTHER PUBLICATIONS

Patent Abst. of Japan, 96, 11, Nov. 1996 for JP 08–179569.
Patent Abst. of Japan, 95, 3, Apr. 1995 for JP 06–348065.
Patent Abst. of Japan, 96, 5, May 1996 for JP 08–015920.

*Primary Examiner*—Christopher D. Rodee
*Attorney, Agent, or Firm*—Fitzpatrick, Cella, Harper & Scinto

[57] ABSTRACT

An electrophotographic two-component type developer includes a toner and a magnetic carrier showing stable charge-imparting performances for a long period of continuous image formation and wherein various environmental conditions. The magnetic carrier comprises: magnetic carrier core particles and a silicone resin coating the magnetic carrier core particles; wherein the silicone resin is characterized by having (i) both (a) a —COO— group and (b) a phenyl group or nitrogen-containing group, (ii) a carbon content attributable to the —COO— group of 10–70 atomic % of silicon constituting the silicone resin, based on ESCA, and (iii) a carbon content attributable to the phenyl group of 0.1–300 atomic % or a nitrogen content attributable to the nitrogen-containing group of 0.01–10 atomic %, respectively, of the carbon content attributable to the —COO— group, based on ESCA.

31 Claims, 7 Drawing Sheets

ELECTROPHOTOGRAPHIC DEVELOPER CARRIER, TWO-COMPONENT TYPE DEVELOPER AND IMAGE FORMING METHOD

FIELD OF THE INVENTION AND RELATED ART

The present invention relates to a carrier for use in an electrophotographic developer for developing an electrostatic image in electrophotography, electrostatic recording, electrostatic printing, etc., a two-component type developer including the carrier, and an image forming method using the developer.

It has been well known to form an electrostatic image on the surface of a photoconductive member and develop the image according to various methods, as disclosed in U.S. Pat. Nos. 2,297,691; 3,666,363; 4,071,361; etc. Generally, an electrostatic image is formed by various means on a photosensitive member using a photoconductor material and then having a toner be attached onto the electrostatic image to form a toner image.

Then, the toner image is transferred as desired onto a surface of an image-supporting material, such as paper and then fixed, e.g., by heating, pressing, heating and pressing, or with solvent vapor, to obtain a copy or a print. In case where the toner image transfer step is included, a step of removing the residual toner from the photosensitive member is generally provided.

The methods for developing an electrostatic image with a toner may, for example, include: the powder cloud method disclosed in U.S. Pat. No. 2,221,776; the cascade developing method disclosed in U.S. Pat. No. 2,618,552; the magnetic brush method disclosed in U.S. Pat. No. 2,874,063; the method using an electroconductive magnetic toner disclosed in U.S. Pat. No. 3,909,258; and the developing method of effecting a development while applying a bias electric field comprising an AC component and a DC component to a developer-carrying member (developing sleeve) (as disclosed, e.g., in Japanese Laid-Open Pat. Appln. (JP-A) 62-63970).

In the magnetic brush developing method, magnetic carrier particles comprising steel, ferrite, etc., are used together with a toner to form a two-component type developer, and the developer is held and aligned in the form of a brush on a developing sleeve containing therein a magnet under the action of a magnetic field exerted by the magnet. When the magnetic brush is caused to contact an electrostatic image surface on a photoconductor layer, only the toner is attracted from the magnetic brush to the electrostatic image to develop the electrostatic image.

Carriers used for constituting two-component type developers used in the magnetic brush developing method may be roughly divided into an electroconductive carrier and an insulating carrier. The electroconductive carrier may ordinarily comprises oxidized or yet unoxidized iron powder. A two-component type developer including such iron powder carrier is accompanied with a difficulty that it has an unstable triboelectrical charging powder to the toner, so that the resultant toner image is liable to be accompanied with fog. More specifically, as the developer is continually used, toner particles are liable to be attached and accumulated to form spent toner. As a result, the iron powder carrier is caused to have an increased electrical resistance, so that the bias current passing through the magnetic brush is reduced, and the triboelectric charging performance of the iron powder carrier becomes unstable. As a result, the image density given by the formed toner image is lowered to increase the fog. Accordingly, in case where a two-component type developer containing iron powder carrier is used for continuous reproduction in an electrophotographic copying machine, the developer is liable to be deteriorated and has to be renewed in a short period, to consequently result in an increased cost.

The insulating carrier may representatively comprise a coated carrier obtained by uniformly surface-coating a carrier core material comprising a ferromagnetic, such as iron, nickel or ferrite with an insulating resin. In a two-component type developer using such an insulating resin-coated carrier, toner particles are noticeably less liable to be attached onto the carrier surface than to the electroconductive non-coated carrier, and it is also easy to control the triboelectric chargeability between the toner and the carrier, so that the coated carrier is excellent in durability and exhibits a long life, thus being suitable for use in an electrophotographic copying machine.

Important properties required of an insulating resin-coated carrier may include: appropriate levels of charging ability, impact resistance and wear resistance, a good adhesion between the carrier core and the coating resin, and a uniformity of charge distribution on the carrier particle surface.

In order to prevent a spent toner accumulation on the carrier due to toner melt sticking, it has been proposed to form a coating layer with a resin having a low surface energy. A carrier coated with silicone resin is said to be less liable to cause spent toner accumulation and provide a developer with a long life. However, the carrier has a weak power of imparting charge to the toner and is therefore liable to result in a toner image with much fog, cause much toner scattering and soiling inside the machine and cause frequent image defects.

In order to obviate the above difficulty, it has been proposed to use a resin-modified silicone resin as a coating resin (JP-A 55-157751). Further, JP-A 1-147478 has proposed a carrier coated with a silicone resin containing an aminosilane coupling agent. However, in case where a toner having a smaller size, e.g., a weight-average particle size of 9 $\mu$m or smaller, is used, even such coated carriers exhibit insufficient toner charge control performance and are liable to result in fog, particularly in a normal temperature/low humidity environment, so that a further improved carrier has been desired.

SUMMARY OF THE INVENTION

A generic object of the present invention is to provide an electrophotographic developer carrier having solved the above-mentioned problems.

A more specific object of the present invention is to provide an electrophotographic developer carrier having a resin coating layer which exhibits excellent adhesion with the carrier core particles and excellent ability of imparting charge to a toner.

Another object of the present invention is to provide an electrophotographic developer carrier exhibiting excellent performances in continuous image formation on a large number of sheets and excellent environmental stability.

Another object of the present invention is to provide an electrophotographic developer carrier exhibiting excellent charge-imparting performance and charge-controlling performance even with respect to a negatively chargeable non-magnetic toner having a small average particle size.

A further object of the present invention is to provide a two-component type developer comprising such a carrier as described above and a toner.

A still further object of the present invention is to provide an image forming method using such a two-component type developer.

According to the present invention, there is provided a magnetic carrier for use in an electrophotographic developer, comprising: magnetic carrier core particles and a silicone resin coating the magnetic carrier core particles; wherein the silicone resin is characterized by having (i) both (a) a —COO— group and (b) a phenyl group or nitrogen-containing group, (ii) a carbon content attributable to the —COO— group of 10–70 atomic % of silicon constituting the silicone resin, based on ESCA, and (iii) a carbon content attributable to the phenyl group of 0.1–300 atomic % or a nitrogen content attributable to the nitrogen-containing group of 0.01–10 atomic %, respectively, of the carbon content attributable to the —COO— group, based on ESCA.

According to another aspect of the present invention, there is provided a two-component type developer for developing an electrostatic image, comprising: a toner and the above-mentioned magnetic carrier.

According to still another aspect of the present invention, there is provided an image forming method, comprising:

forming an electrostatic image on a photosensitive member, forming a magnetic brush of the above-mentioned two-component type developer on a developer-carrying member enclosing a magnetic field generating means, and developing the electrostatic image with the magnetic brush formed on the developer-carrying member to form a toner image on the photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

As a result of our study regarding a surface composition of a carrier expected to remarkably affect various carrier performances, we have found it possible to provide a carrier having excellent performances by appropriately selecting atomic ratios of certain atoms attributable to functional groups. More specifically, in the present invention, the amount of silicon, the amount of benzene ring or nitrogen-containing group and the amount of —COO— group in a resin coating layer of a carrier are controlled to provide solutions to the above-mentioned problems and also to the problem of image flow.

The control of the above-mentioned contents of certain atoms in the present invention may be made based on results of measurement by ELECTRON SPECTROSCOPY FOR CHEMICAL ANALYSIS (sometimes abbreviated as "ESCA") by using, e.g., "MODEL-5600 ci" available from PHYSICAL ELECTRONICS, INC., a monochromatic X-ray source ($AlK_{\alpha}$, 14 kV-350 W), an aperture size of 800 $\mu$m in diameter and a sampling angle of 75 deg.

More specifically, the atomic content measurement by ESCA for surface analysis of a silicone resin-coated carrier in the present invention is based on peaks at 102.0 eV±0.5 eV for Si atoms constituting the silicone resin, at 289.0 eV±0.5 eV for C atoms in —COO— group, at 291.7 eV±0.5 eV for C atoms in phenyl group, and at 400.0 eV±0.5 eV for N atoms in nitrogen-containing group.

Figure 4:
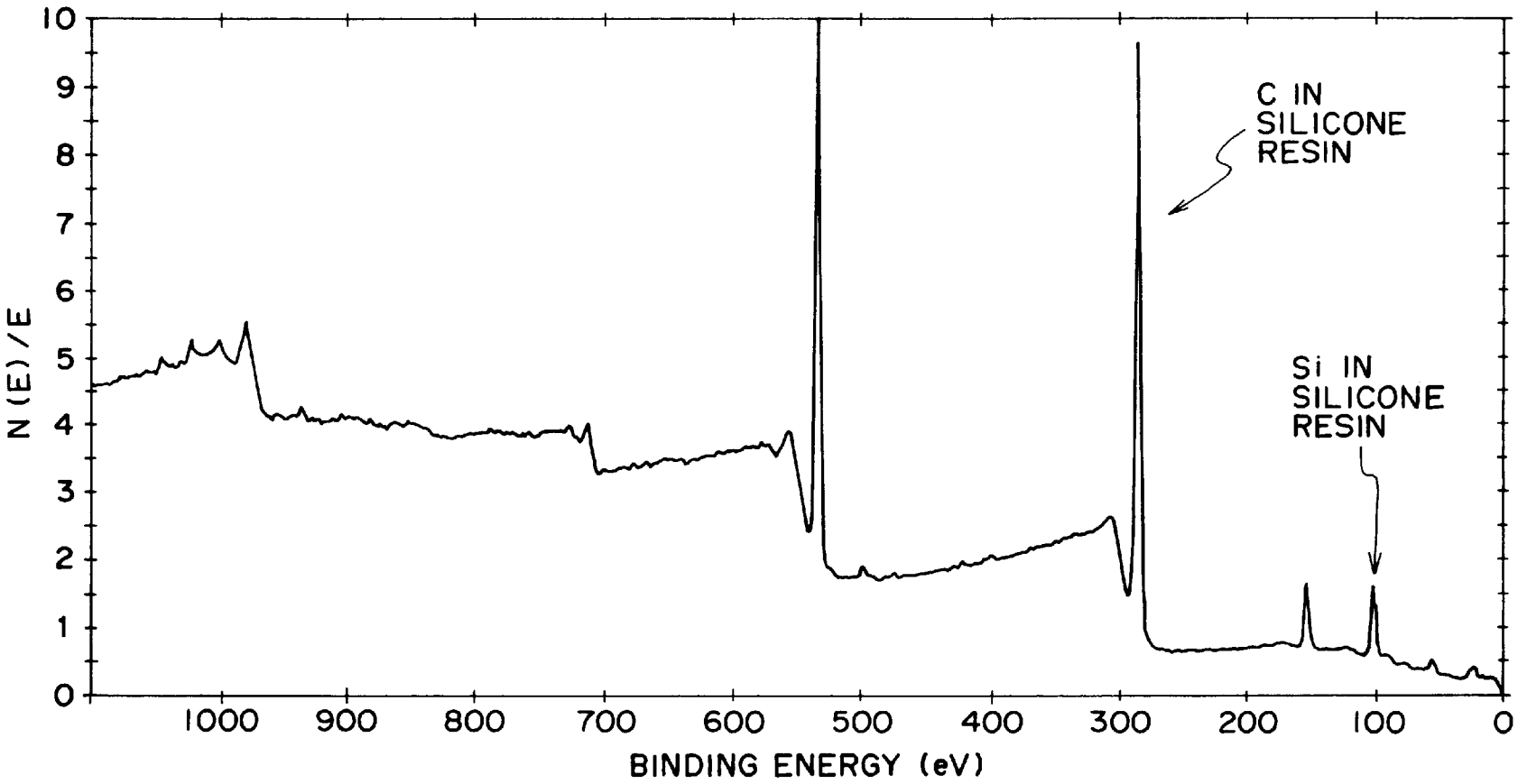
FIGS. 4–7 are ESCA charts for Magnetic Carrier No. 2 prepared in Example 2.
Figure 5:
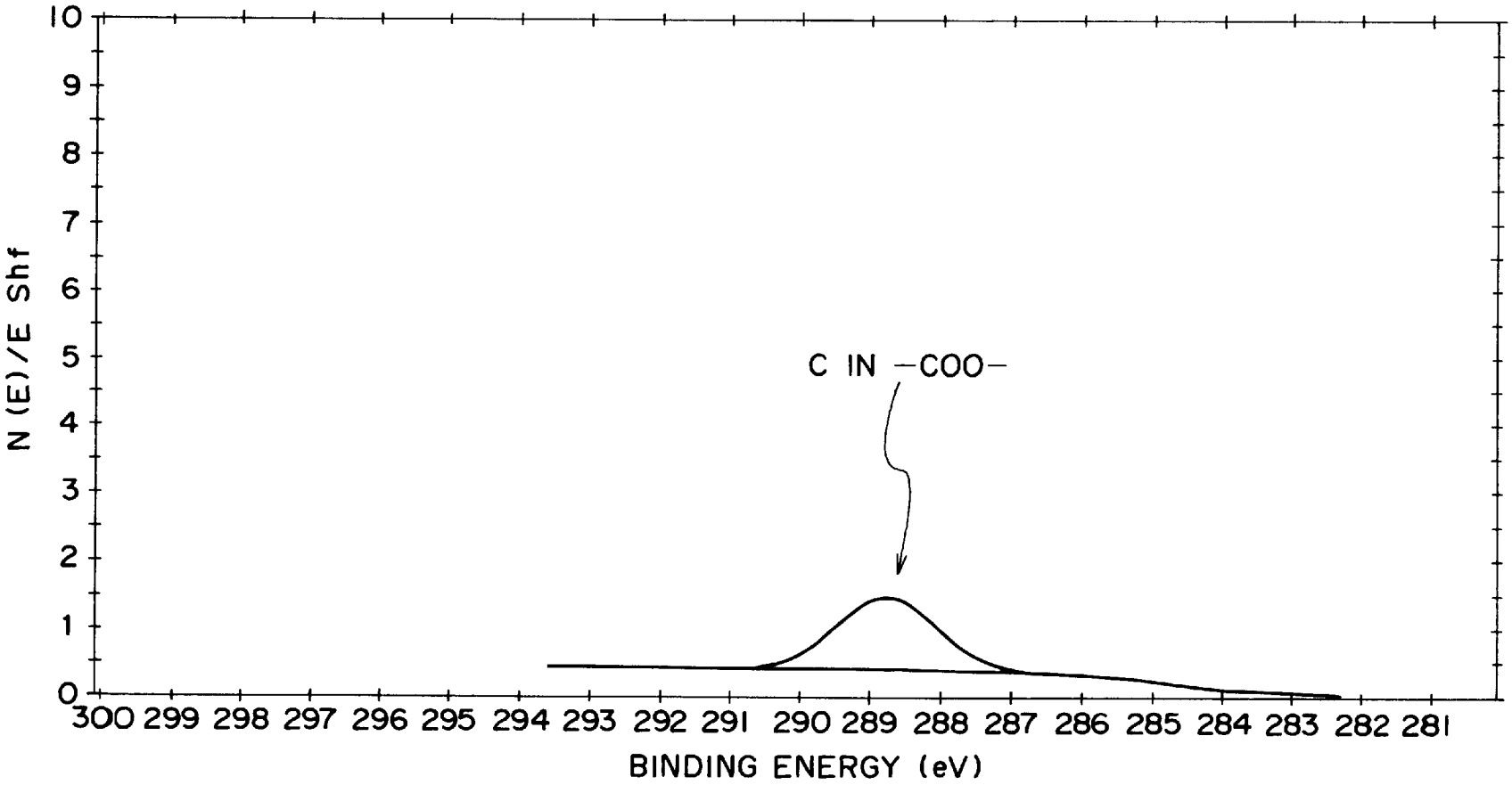
Figure 6:
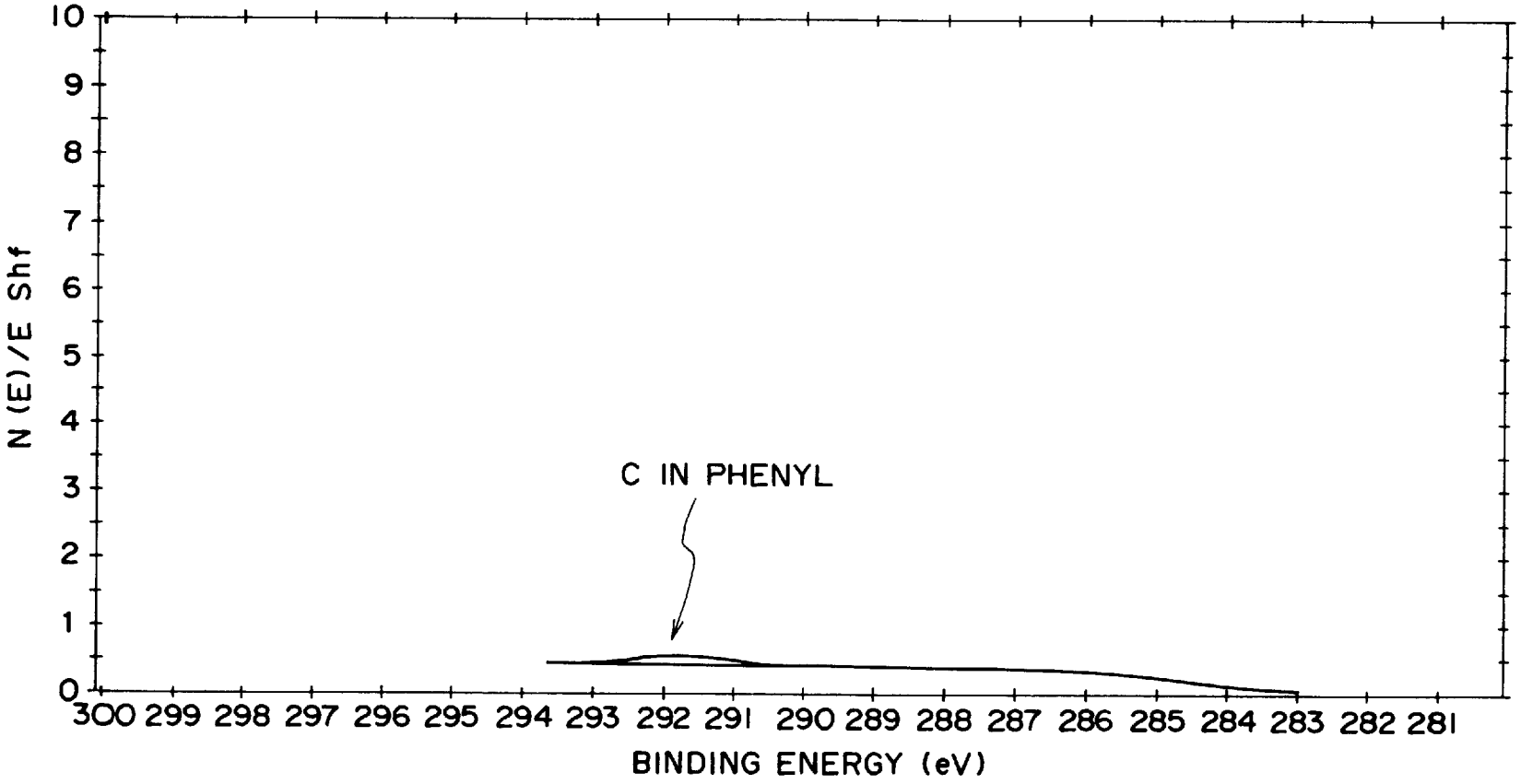
Figure 7:
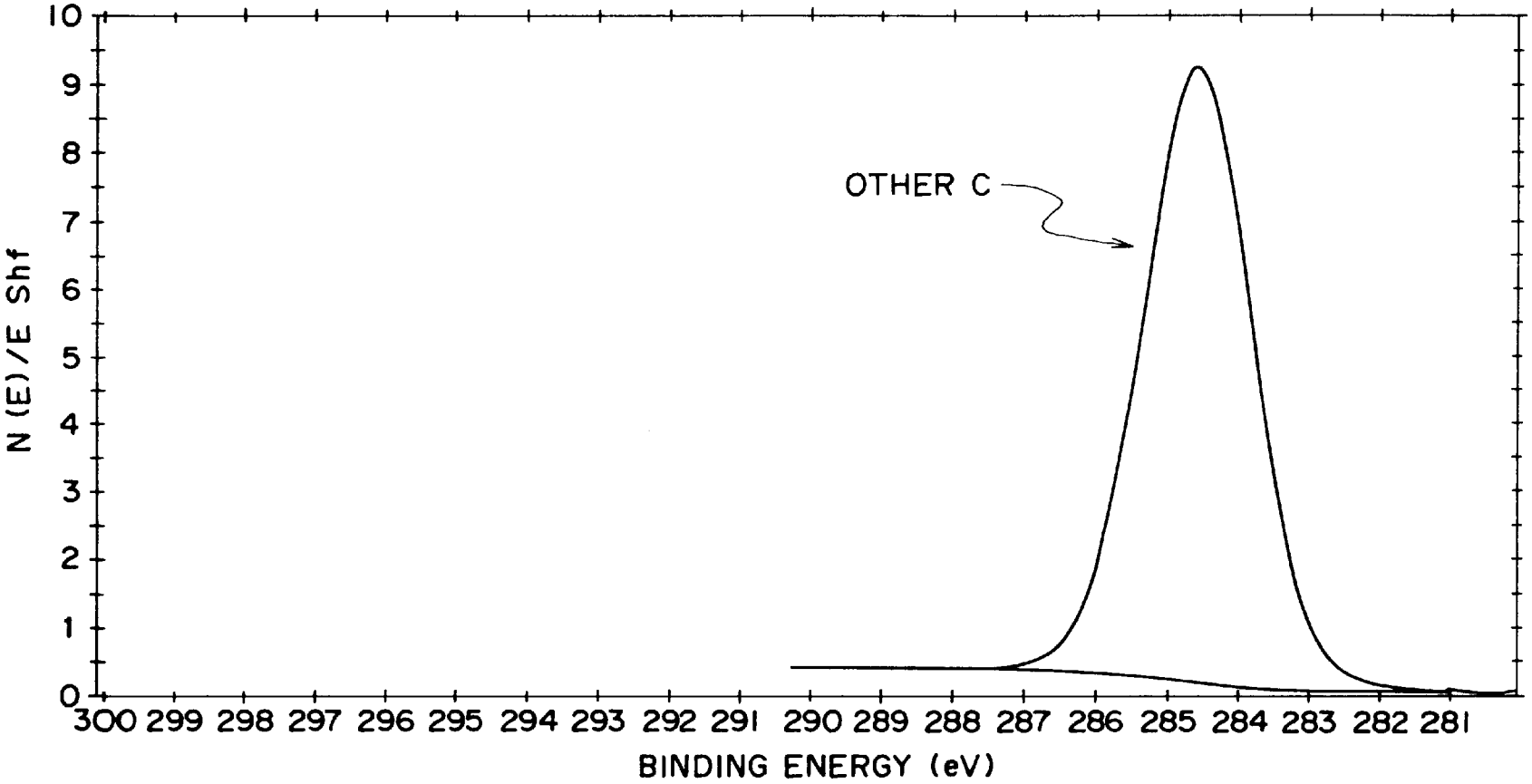

For example, FIGS. 4–7 are ESCA charts for Magnetic Carrier No. 2 prepared in Example 2 described hereinafter having C(—COO—)/Si=63 atom. % and C (phenyl)/C(—COO—)=11.1 atom. % according to ESCA analysis. More specifically, FIG. 4 is an ESCA chart giving a ratio between number of Si atoms in silicone resin (at 102.0±0.5 eV) and number of C atoms in silicone resin (at 282–295 eV). According to a further detailed analysis of the region of 282–295 eV, a sharp peak of C in FIG. 4 is divided into chemical shifts of C in —COO— (having a peak at 282–295.0±0.5 eV) shown in FIG. 5, C in phenyl (having a peak at 291.7±0.5 eV) and other C (carbon atoms). As a result, FIG. 4 shows Si 7.75 atom. % and C 64.17 atom. % in the silicone resin. FIGS. 5–7 show intensity ratios of carbon atoms 7.59 for C (—COO—), 0.85 for C (phenyl) and 91.55 for C (other). From the results, ESCA parameters for Magnetic Carrier No. 2 gave the following results:

$$C(—COO—)/Si=(64.17\times0.0759/8.75)\times100=\text{ca. } 63 \text{ atom. } \%$$

$$C(\text{phenyl})/C(—COO—)=(0.85/7.59)\times100=\text{ca. } 11.1 \text{ atom. } \%$$

The silicone resin coating layer of the magnetic carrier of the present invention satisfies a percentage of 10–70 atomic %, preferably 15–65 atomic %, of the carbon content attributable to —COO— group in the silicone resin relative to the silicon content constituting the silicone resin (i.e., (C in —COO— group/Si)×100), according to ESCA. In case where the percentage of (C in —COO— group/Si)×100 is below 10 atomic % indicating no or less —COO— group, it becomes difficult to provide a sufficient charge to a toner, particularly a small-particle size toner having a weight-average particle size of at most 9 $\mu$m, even if the silicone resin-coating layer is thickened to enhance the insulating property and suppress the charge leakage, thereby resulting in inferior dot reproducibility of digital latent images and inferior environmental stability. On the other hand, in case where the percentage of (C in —COO— group/Si)×100 is above 70 atomic % indicating excessive —COO— group, the effect of suppressing image flow is lowered and the releasability of the silicone resin coating layer surface is lowered to cause accumulation of spent toner, thus resulting in inferior continuous image forming performance on a large number of sheets. By causing the silicone resin coating layer to contain —COO— group and silicon in appropriate amounts, it is possible to provide a resin-coated carrier free from causing image flow, and having a sufficient charge-imparting ability, an excellent environmental stability and a sufficient durability.

Further, the silicone resin coating layer satisfies a percentage of 0.1–300 atomic %, preferably 10–200 atomic %, of the carbon content attributable to phenyl group relative to the carbon content attributable to —COO— group (i.e., (C in phenyl/C in —COO—)×100), according to ESCA.

By including an appropriate ratio of carbon content attributable to phenyl group relative to the carbon content attributable to —COO— group, it is possible to provide a silicone resin-coated carrier which has a good developing performance and excellent chargeability and is free from causing a density decrease during continuous image formation, particularly due to a charge-up (i.e., excessive charge) in a low humidity environment, thus exhibiting an extremely long life.

The mechanisms for the above-mentioned excellent results have not been fully clarified, but it may be possible to assume that the co-presence of carbon content attributable to phenyl group and carbon content attributable to —COO— group in a certain specific ratio provides a good balance between charge-imparting ability and charge-diffusing ability to provide a coated magnetic carrier having good developing performance and long life. The case where the percentage of (C in phenyl/C in —COO—)×100 is below 0.1 atomic % indicating no or less phenyl group, the image density is liable to be lowered during continuous image formation presumably because the rate of charge diffusion is lowered to cause a charge accumulation during continuous image formation and result in charge-up. On the other hand, in case where the percentage of (C in phenyl/C in —COO—)×100 exceeds 300 atomic %, the resultant two-component type developer is liable to exhibit a lower developing performance and cause a change in toner particle size distribution during continuous image formation, thus resulting in an increased ratio of coarse toner particles in the developing apparatus leading to a lower image quality. By forming a coating layer having carbon content attributable to phenyl group and carbon content attributable to —COO— group in an appropriate ratio, it becomes possible to provide a coated carrier having good developing performance and sufficient durability.

Further, it is also possible to obtain a good silicone resin-coated magnetic carrier in the case where the silicone resin coating layer satisfies a percentage of 0.01–10 atomic %, preferably 0.1–5 atomic %, of a nitrogen content attributable to nitrogen-containing group in the silicone resin relative to the carbon content attributable to —COO— group in the silicone resin, (i.e., N/C in —COO—), according to ESCA.

By including an appropriate content of nitrogen relative to the carbon content of —COO— it is possible to provide a carrier exhibiting an excellent initial charging performance and also an extremely long life, free from a lower image density during continuous image formation, particularly due to a remarkable charge-up in a low humidity environment.

The mechanisms for the above-mentioned excellent results have not been fully clarified as yet, but it may be possible to assume that the co-presence of the nitrogen content and the carbon content of —COO— in a certain specific ratio provides a good balance between charge-imparting and charge-diffusion to provide a silicone resin-coated magnetic carrier of a long life. In case where the percentage of (N/C in —COO—)×100 is below 0.01 atomic % indicating no or little nitrogen-containing group, the coated carrier is liable to exhibit a low charging ability and a large charge-diffusion property, thus resulting in a slow charging speed leading to difficulties, such as toner scattering and fog. On the other hand, in case where the percentage of (N/C in —COO—)×100 exceeds 10 atomic %, the charge-diffusion ability is lowered so that the image density is lowered during continuous image formation due to charge accumulation and charge-up.

The silicone resin used in the present invention characterized by the above-mentioned surface composition based on ESCA and may for example comprise methacrylate-modified silicone resin, acrylate-modified silicone resin, styrene/acrylate-modified silicone resin, styrene/methacrylate-modified silicone resin, amino-modified silicone resin, dimethylsilicone resin, diphenylsilicone resin, epoxy-modified silicone resin, and methylphenylsilicone resin. These silicone resins may be used singly or in mixture of two or more species.

More specifically, such silicone resins may be produced by using compounds, such as

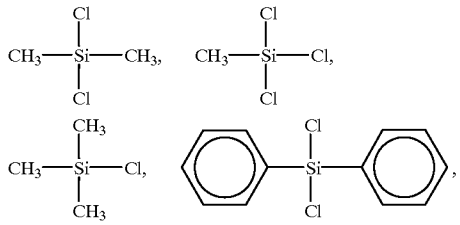

etc. to form silicone oligomer or silicone resin having structural units of the following formula (I) and (II):

(I)

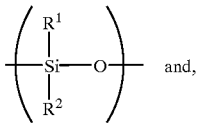

and, (II)

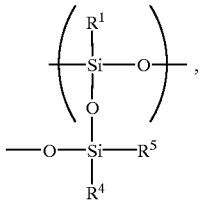

wherein $R^1$–$R^5$ independently denote a hydrocarbon group selected from methyl, ethyl and phenyl.

At the time of forming the silicone oligomer or silicone resin, a compound of the following formula (III), (IV), (Va) or (Vb) may be co-present.

(III)

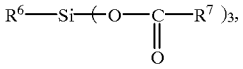

wherein $R^6$ and $R^7$ independently denote a hydrocarbon group having at least one carbon atom;

(IV)

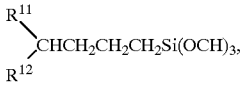

wherein $R^{11}$ and $R^{12}$ independently denote H, $CH_3$, $CH_2CH_2$ or

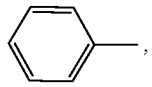

(Va)

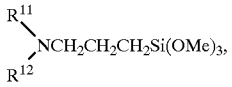

wherein $R^{11}$ and $R^{12}$ independently denote H, $CH_3$, $CH_2CH_2$ or

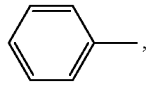

(Vb)

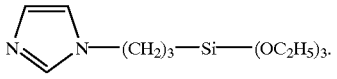

It is also possible that the above-prepared silicone oligomer or silicone resin is used in combination with an oligomer or resin formed by reacting a methacrylate (ester) or an acrylate (ester) with a compound of the following formula (VI):

(VI)

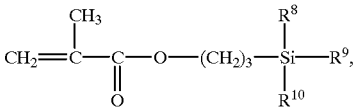

wherein $R^8$, $R^9$ and $R^{10}$ independently denote $CH_3$, $CH_2CH_3$, $OHC_3$ or $OCH_2CH_3$ provided that at least one of $R^8$, $R^9$ and $R^{10}$ is $OCH_3$ or $OCH_2CH_3$.

The carrier core material of the silicone resin-coated magnetic carrier may comprise a known material, examples of which may include: particles of ferromagnetics, such as iron and cobalt, resin particles containing magnetic materials dispersed therein, magnetite particles, hematite particles, and ferrite particles. It is preferred to use ferrite particles or iron particles allowing easy surface control, particularly preferably ferrite particles.

The carrier core material used in the present invention may preferably have a number-average particle size of 20–100 μm, particularly 30–65 μm. This is because a number-average particle size of below 20 μm provides much fine powder in carrier particle distribution and a smaller magnetization per particle, thus being liable to result in carrier scattering. If the carrier has a number-average particle size exceeding 100 μm, the carrier is caused to have a decreased specific surface area, thus being liable to cause toner scattering, and the reproducibility of particularly a solid image portion is lowered in formation of full color images rich in solid image portions.

The silicone resin coating layer may suitably be formed by applying a coating liquid in the form of a solution in a solvent, which may be an organic solvent, such as toluene, xylene, methyl ethyl ketone, or methyl isobutyl ketone.

The coating liquid may be prepared so as to finally provide a silicone resin-coated magnetic carrier having a surface exhibiting the above-described atomic composition according to ESCA and, after coating magnetic carrier core particles with the coating liquid, the coating layer may be subjected to baking or sintering at 120–170° C. which is rather lower than an ordinary sintering temperature. This is because a sintering temperature below 120° C. results in a carrier having a lower flowability and a lower resistance to spent toner accumulation. On the other hand, a sintering temperature in excess of 170° C. may provide a carrier having a lower charging ability and being liable to result in toner scattering and fog, presumably because of oxidation of acrylic group or nitrogen-containing group, while the reason has not been clarified as yet.

The sintering or baking apparatus may be of either an external heating type or an internal heating type and may for example comprise a fixed or fluidized electric furnace, a rotary electric furnace, a burner furnace, or a microwave baking apparatus.

The resin coating amount in the silicone resin-coated magnetic carrier may be 0.1–5.0 wt. %, preferably 0.15–2.0 wt. %, of the total weight of silicone resin-coated magnetic carrier.

The coated carrier of the present invention may be used in combination with a toner, which may suitably have a weight-average particle size of at most 9 μm, preferably in a range of 3.0–8.0 μm.

The toner comprises a binder resin, examples of which may include: polystyrene, and styrene copolymers, such as styrene-butadiene copolymer, and styrene-acrylic copolymer; ethylene copolymers, such as ethylene-vinyl acetate copolymer and ethylene-vinyl alcohol copolymers; phenolic resin, epoxy resin, polyamide resin, polyester resin, and maleic acid resin.

The carrier according to the present invention may exhibit remarkable effects, especially when combined with a toner comprising as a binder resin a polyester resin having a high negative chargeability among the above-mentioned resins.

It is particularly preferred to use a polyester resin having a sharp melting characteristic obtained by co-polycondensation of a bisphenol derivative of the following formula:

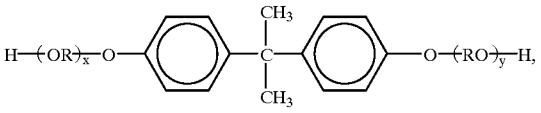

wherein R denotes an ethylene or propylene group, x and y are independently an integer of at least 1 with the proviso that the average of x+y is in the range of 2–10, as a diol component, with a carboxylic acid component selected from carboxylic acids having two or more carboxyl groups, and anhydrides and lower alkyl esters thereof, such as fumaric acid, maleic acid, maleic anhydride, phthalic acid, terephthalic acid, trimellitic acid and pyromellitic acid.

The toner may contain a colorant, which may comprise a known dye or pigment, examples of which may include: Phthalocyanine Blue, Indanthrene Blue, Peacock Blue, Permanent Red, Lake Red, Rhodamine Lake, Hanza Yellow, Permanent Yellow, and Benzidine Yellow, e.g., for a non-magnetic toner. The content thereof may be at most 12 wt. parts, preferably 0.5–9 wt. parts, per 100 wt. parts of the binder resin, so as to provide a sensitive transparency suitable for OHP films.

The toner used in the present invention can contain a charge control agent so as to have an optimum triboelectric chargeability depending on a developing system used.

It is preferred to use as a negative charge control agent an organometallic complex or chelate compound, examples of which may include: azo metal complexes, aluminum acetylacetonate, iron (II) acetylacetonate, chromium 3,5-di-tert-butylsalicylate, aluminum 3,5-di-tert-butylsalicylate, and zinc 3,5-di-tert-butylsalicylate. Particularly preferred examples thereof may include: metal complexes of acetylacetone (inclusive of mono-alkyl and dialkyl substitution derivatives thereof), metal complexes of salicylic acid (inclusive of mono-alkyl and di-alkyl substitution derivatives thereof), and salts of these. It is particularly preferred to use a metal complex or salt of salicylic acids.

Such a charge control agent may suitably be added to a toner in an amount of 0.1–20 wt. parts, preferably 0.2–10 wt. parts, per 100 wt. parts of the binder resin. It is particularly preferred to use a colorless or only pale-colored charge control agent when used for color image formation.

To the toner used in the present invention, it is suitable to blend or add fine powder of a material, such as silica, alumina, titanium oxide, polytetrafluoroethylene, polyvinylidene fluoride, polymethyl methacrylate, polystyrene, and silicone resin. By adding such a fine powdery material to the toner, the fine powder is caused to be present between the toner and carrier particles and between the toner particles, so that the resultant developer is provided with an improved flowability and also an improved life. Such a fine powdery material may provide good results, if it has a specific surface area of at least 30 $m^2/g$, particularly 50–400 $m^2/g$, as measured by nitrogen adsorption according to the BET method. Such a fine powdery material may suitably be added in a proportion of 0.1–20 wt. % of the toner.

In order to provide the toner used in the present invention with an improved releasability at the time of hot roller fixation, it is possible to add to the toner a wax component, such as polyethylene, polypropylene, microcrystalline wax, carnauba wax, sasol wax, or paraffin wax.

A toner having a composition as described above may be produced by sufficiently blending the binder resin, the colorant, the charge control agent, and other additives by a blender, followed by melt-kneading for mutual dissolution of the resins of the blend and dispersion of the colorant (pigment or dye) therein, cooling for solidification of the kneaded product. Pulverization and classification to recover toner particles. The toner particles thus prepared can be used as they are but it is possible to add thereto a species and an amount, as desired, of a fine powdery material as described above before use of the toner.

The external addition of such a fine powdery material may be performed by using a blender such as a Henschel mixer. The thus-obtained toner may be blended with the carrier particles according to the present invention to provide a two-component type developer. The thus-formed two-component type developer may suitably container the toner in a proportion of 1–20 wt. %, preferably 1–10 wt. %, of the developer, while the proportion can depend on a developing process used. The toner in the two-component type developer may suitably have a triboelectric chargeability of 20–100 $\mu$C/g. most preferably 30–60 $\mu$C/g, when measured according to a method described hereinafter.

Various properties and parameters of carriers and toners described herein are based on values described below.

Average Diameter of Carrier

At least 300 particles (having diameter of 0.1 $\mu$m or larger) are taken at random from sample carrier particles by observation through an optical microscope, and an image analyzer ("Luzex 3", available from Nireco K.K.) is used to measure a horizontal FERE diameter of each particle as a particle size. From the particle sizes of at least 300 particles thus measured, a number-average particle size is calculated.

Coulter Counter TA-II or Coulter Multisizer II (available from Coulter Electronics Inc.) is used together with an electrolytic solution comprising a ca. 1% NaCl aqueous solution which may be prepared by dissolving a reagent-grade sodium chloride or commercially available as "ISOTON-II" (from Counter Scientific Japan).

For measurement, into 10 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 $\mu$m-aperture. The volume and number of toner particles are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 $\mu$m; 2.52–3.17 $\mu$m; 3.17–4.00 $\mu$m; 4.00–5.04 $\mu$m; 5.04–6.35 $\mu$m; 6.35–8.00 $\mu$m; 8.00–10.08 $\mu$m, 10.08–12.70 $\mu$m; 12.70–16.00 $\mu$m; 16.00–20.20 $\mu$m; 20.20–25.40 $\mu$m; 25.40–32.00 $\mu$m: and 32.00–40.30 $\mu$m.

Toner Agglomeratability

Agglomeratability of a toner sample containing an external additive is measured as a measure for evaluating the flowability of the toner sample. A large agglomeratability means a lower flowability.

Powder Tester (available from Hosokawa Micron K.K.) quipped with a digital vibration meter ("Digivibro MODEL 1332") is used as a measurement apparatus.

For measurement, a 200-mesh sieve, a 100-mesh sieve and a 60-mesh sieve are set in superposition in this order from a narrower mesh sieve on a vibration table so that the 60-mesh sieve is placed at the uppermost.

On the set sieves, accurately weighed 5 g of a sample toner is placed, and the sieves are vibrated for ca. 15 sec. while setting an input voltage to the vibration table of 21.7 volts and a displacement value to the digital vibration meter of 0.130 so as to provide a vibration amplitude of the vibration table in the range of 60–90 $\mu$m (rheostat scale of ca. 2.5). Then, the weights (a, b and c g) of the toner remaining on the respective sieves are measured to calculate the agglomeratability according to the following formula:

$$\text{Agglomeratability } (\%)=[a/5+(5/b)\times(3/5)+(c/5)\times(1/5)]\times 100,$$

wherein a: weight of toner on 60-mesh sieve (g)

b: weight of toner on 100-mesh sieve (g)

c: weight of toner on 200-mesh sieve (g)

A sample toner has been left standing for ca. 12 hours in an environment of temperature 23° C. and humidity 60% RH, and the measurement is performed in an environment of temperature 23° C. and humidity 60 % RH.

Figure 1:
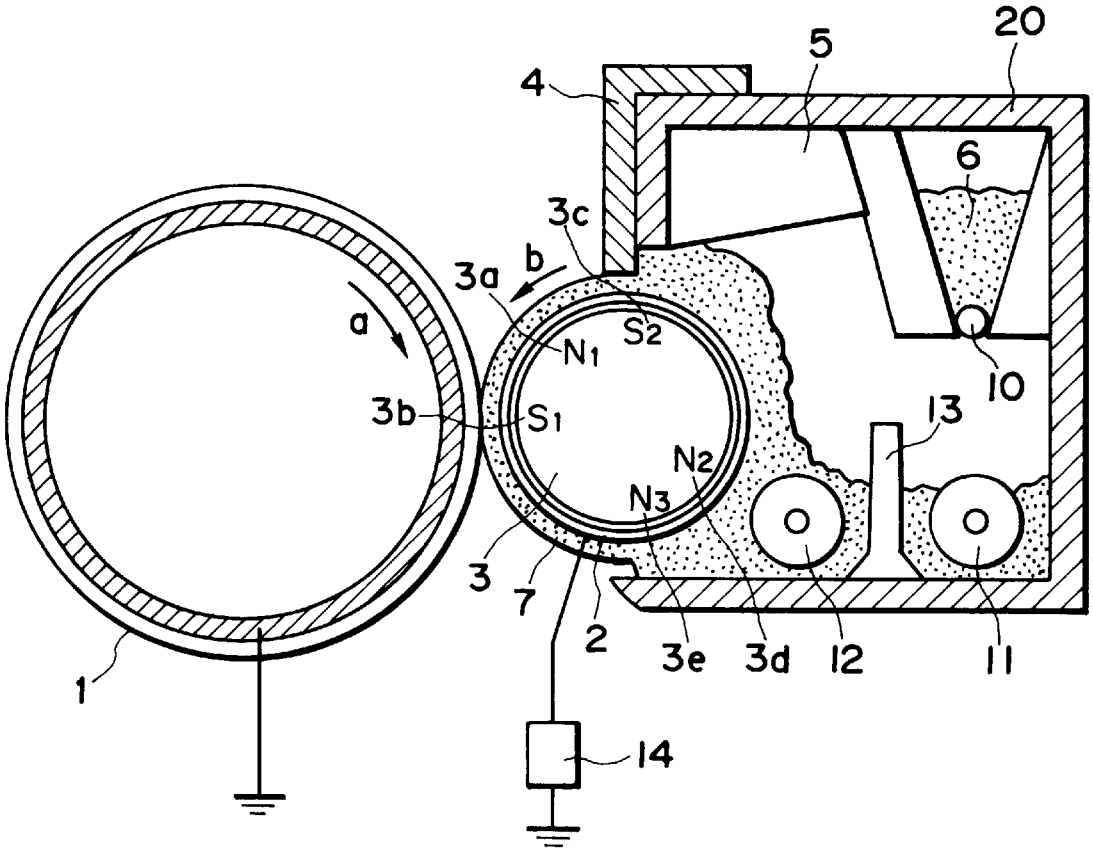
FIG. 1 is a schematic sectional illustration of an exemplary image forming apparatus for practicising an embodiment of the image forming method according to the invention.

Next, an embodiment of the image forming method according to the invention is described with reference to FIG. 1 showing a developing apparatus used therein.

An electrostatic image-bearing member (typically, a photosensitive member) 1 comprises an insulating drum for electrostatic recording, or a photosensitive drum or photosensitive belt comprising a layer of a photoconductive insulating substance, such as a (amorphous)-Se, CdS, $ZnO_2$, OPC (organic photoconductor) or a-Si. The electrostatic image-bearing member 1 is rotated in a direction of an arrow a by a drive mechanism (not shown). A developing sleeve (developer-carrying member) 2 is disposed in proximity to or in contact with the electrostatic image-bearing member 1 and is composed of a non-magnetic material, such as aluminum or SUS316. The developing sleeve 2 is axially rotatably and laterally disposed so that almost a right half circumference of the developing sleeve 2 is caused to project into a laterally elongated opening formed at a lower left wall of a developer vessel 20 in a longitudinal direction of the developer vessel 20, and almost a left half circumference thereof is exposed outside the vessel.

A fixed permanent magnet 3 as a fixed magnetic field generating means is inserted into the developing sleeve (developer-carrying member) 2 and is fixed on a position as shown. The magnet 3 is held in a fixed position as shown even when the developing sleeve 2 is driven in rotation. The magnet 3 has 5 magnetic poles including N poles 3*a*, 3*d* and 3*e* and S poles 3*b* and 3*c*. The magnet 3 may comprise an electromagnet instead of the permanent magnet.

A non-magnetic blade 4 as a developer-regulating member is disposed on an upper edge of the developer supply vessel opening by fixing its base portion to the vessel side wall. The blade 4 is composed of, e.g., SUS 316 and is bent into a sectional shape of character "L" as shown in FIG. 1. A magnetic carrier-regulating member 5 is disposed on a lower side of the non-magnetic blade 4 so as to provide its front lower side as a developer guide surface and form a regulating member together with the non-magnetic blade 4.

A layer 7 of a developer comprising a toner 6 and a carrier according to the present invention is formed on the developing sleeve 2.

The toner 6 is supplied through a toner supply roller 10 operated depending on an output of a toner-density detection sensor (not shown). The sensor may comprise a developer volume-detection-type sensor, a piezoelectric device, an inductance change detection device, an antenna-type sensor utilizing an alternating bias, or an optical density detection-type sensor. By rotating or stopping the roller 10, the non-magnetic toner 6 is supplied. A fresh developer supplied with the toner 6 is blended and stirred while being conveyed by a developer conveying screw 11 and, during the conveyance, the supplied toner is triboelectrically charged. A partitioning wall 13 is disposed in a longitudinal direction of the developer vessel 20 (in a direction perpendicular to the drawing) so as to be provided with notches or cuts at both longitudinal ends thereof where the fresh developer conveyed by the screw 11 is transferred to a screw 12.

A magnetic pole 3*d* is a conveying pole and functions to recover the developer after the development and convey the developer in the vessel to the regulating zone.

In a zone close to the pole 3*d*, the conveyed fresh developer and the recovered developer are exchanged by the screw 12 disposed in proximity to the developing sleeve 2.

The non-magnetic blade 4 is disposed with a spacing of 100–900 μm, preferably 150–800 μm, from the surface of the developing sleeve 2. If the spacing is smaller than 100 μm, the carrier particles are liable to clog the spacing, thus providing an ununiform developer layer and failing to supply an amount of developer required for satisfactory developer, to result in only developed image with a small density and much irregularity in some cases. On the other hand, if the spacing is larger than 900 μm, the amount of developer applied onto the developing sleeve is increased to fail in regulation of a prescribed developer layer thickness and result in attachment of an increased amount of magnetic particles onto the electrostatic image-bearing member 1. Further, as the developer circulation and the regulation of the developer by the developer-regulation member are weakened to result in a toner having an insufficient triboelectric charge which is liable to provide increased fog.

It is preferred to control the developer layer thickness on the developing sleeve 2 to be similar to or slightly layer than an opposite gap between the developing sleeve 2 and the electrostatic image-bearing member 1 and apply an alternating voltage to the developing sleeve 2. The gap may be 50–800 μm, preferably 100–700 μm.

By applying a developing bias voltage comprising an alternating voltage alone or in superposition with a direct voltage to the developing sleeve 2 from a bias voltage supply 14, the movement of the toner from the developing sleeve 2 to the electrostatic image-bearing member 10 may be facilitated to provide a better quality image.

The alternating voltage may be an AC voltage of 1,000–10,000 Vpp, preferably 2,000–8,000 Vpp. The DC voltage superposed, as desired, may preferably be at most 1000 volts.

An image forming apparatus suitable for practicing full-color image forming method by using a developer according to the present invention will be described with reference to FIG. 2.

Figure 2:
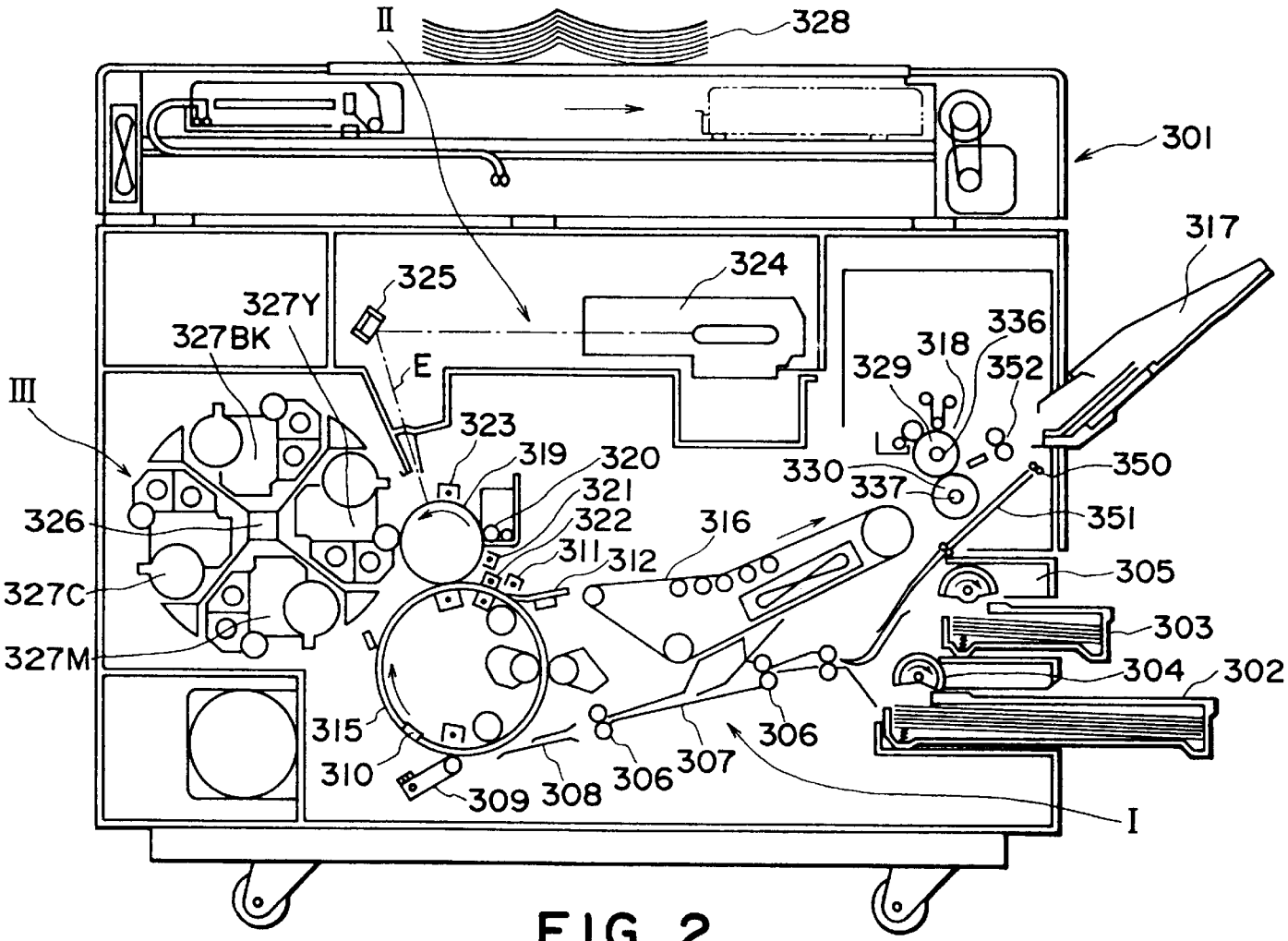
FIG. 2 is a schematic illustration of a full-color copying apparatus for full-color image formation as another embodiment of the image forming method according to the invention.

The color electrophotographic apparatus shown in FIG. 2 is roughly divided into a transfer material (recording sheet)-conveying section I including a transfer drum 315 and extending from the right side (the right side of FIG. 2) to almost the central part of an apparatus main assembly 301, a latent image-forming section II disposed close to the transfer drum 315, and a developing means (i.e., a rotary developing apparatus) III.

The transfer material-conveying section I is constituted as follows. In the right wall of the apparatus main assembly 301, an opening is formed through which are detachably disposed transfer material supply trays 302 and 303 so as to protrude a part thereof out of the assembly. Paper (transfer material)-supply rollers 304 and 305 are disposed almost right above the trays 302 and 303. In association with the paper-supply rollers 304 and 305 and the transfer drum 315 disposed leftward thereof so as to be rotatable in an arrow A direction, paper-supply rollers 306, a paper-supply guide 307 and a paper-supply guide 308 are disposed. Adjacent to the outer periphery of the transfer drum 315, an abutting roller 309, a glipper 310, a transfer material separation charger 311 and a separation claw 312 are disposed in this order from the upperstream to the downstream alone the rotation direction.

Inside the transfer drum 315, a transfer charger 313 and a transfer material separation charger 314 are disposed. A portion of the transfer drum 315 about which a transfer material is wound about is provided with a transfer sheet (not shown) attached thereto, and a transfer material is closely applied thereto electrostatically. On the right side above the transfer drum 315, a conveyer belt means 316 is disposed next to the separation claw 312, and at the end (right side) in transfer direction of the conveyer belt means 316, a fixing device 318 is disposed. Further downstream of the fixing device is disposed a discharge tray 317 which is disposed partly extending out of and detachably from the main assembly 301.

The latent image-forming section II is constituted as follows. A photosensitive member (e.g., an OPC photosensitive drum) 319 (or an OPC photosensitive belt) as a latent image-bearing member rotatable in an arrow direction shown in the figure is disposed with its peripheral surface in contact with the peripheral surface of the transfer drum 315. Generally above and in proximity with the photosensitive drum 319, there are sequentially disposed a discharging charger 320, a cleaning means 321 and a primary charger 323 from the upstream to the downstream in the rotation direction of the photosensitive drum 319. Further, an imagewise exposure means including, e.g., a laser 324 and a reflection means like a mirror 325, is disposed so as to form an electrostatic latent image on the outer peripheral surface of the photosensitive drum 319.

The rotary developing apparatus III is constituted as follows. At a position opposing the photosensitive drum 319, a rotatable housing (hereinafter called a "rotary member") 326 is disposed. In the rotary member 326, four-types of developing devices are disposed at equally distant four radial directions so as to visualize (i.e., develop) an electrostatic latent image formed on the outer peripheral surface of the photosensitive drum 319. The four-types of developing devices include a yellow developing device 327Y, a magenta developing device 327M, a cyan developing apparatus 327C and a black developing apparatus 327BK.

The entire operation sequence of the above-mentioned image forming apparatus will now be described based on a full color mode. As the photosensitive drum 319 is rotated in the arrow direction, the drum 319 is charged by the primary charger 323. In the apparatus shown in FIG. 2, the moving peripheral speeds (hereinafter called "process speed") of the respective members, particularly the photosensitive drum 319, may be at least 100 mm/sec, (e.g., 130–250 mm/sec). After the charging of the photosensitive drum 319 by the primary charger 323, the photosensitive drum 329 is exposed imagewise with laser light modulated with a yellow image signal from an original 328 to form a corresponding latent image on the photosensitive drum 319, which is then developed by the yellow developing device 327Y set in position by the rotation of the rotary member 326, to form a yellow toner image.

A transfer material (e.g., plain paper) sent via the paper supply guide 307, the paper supply roller 306 and the paper supply guide 308 is taken at a prescribed timing by the glipper 310 and is wound about the transfer drum 315 by means of the abutting roller 309 and an electrode disposed opposite the abutting roller 309. The transfer drum 315 is rotated in the arrow A direction in synchronism with the photosensitive drum 319 whereby the yellow toner image formed by the yellow-developing device is transferred onto the transfer material at a position where the peripheral surfaces of the photosensitive drum 319 and the transfer drum 315 abut each other under the action of the transfer charger 313. The transfer drum 315 is further rotated to be prepared for transfer of a next color (magenta in the case of FIG. 2).

On the other hand, the photosensitive drum 319 is charge-removed by the discharging charger 320, cleaned by a cleaning blade or cleaning means 321, again charged by the primary charger 323 and then exposed imagewise based on a subsequent magenta image signal, to form a corresponding electrostatic latent image. While the electrostatic latent image is formed on the photosensitive drum 319 by imagewise exposure based on the magenta signal, the rotary member 326 is rotated to set the magenta developing device 327M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 322 and 314, released from holding by the glipper 310, separated from the transfer drum 315 by the separation claw 312 and sent via the conveyer belt 316 to the fixing device 318, where the four-color toner images are fixed under heat and pressure. Thus, a series of full color print or image formation sequence is completed to provide a prescribed full color image on one surface of the transfer material.

Alternatively, the respective color toner images can be once transferred onto an intermediate transfer member and then transferred to a transfer material to be fixed thereon.

The fixing speed of the fixing device is slower (e.g., at 90 mm/sec) than the peripheral speed (e.g., 160 mm) of the photosensitive drum. This is in order to provide a sufficient heat quantity for melt-mixing yet un-fixed images of two to four toner layers. Thus, by performing the fixing at a slower speed than the developing, an increased heat quantity is supplied to the toner images.

EXAMPLE 1

A coating liquid for forming a surface-coating layer onto magnetic carrier core particles was prepared in the following manner.

33 mol parts of Compound (1), 35 mol parts of Compound (2) and 2 mol parts of Compound (3), respectively shown below, were dissolved in xylene and the resultant xylene solution was added dropwise into a vessel containing warm water at 70–80° C. to cause polycondensation of the silicone compounds, thereby forming a silicone oligomer having the above-mentioned structural units (I) and (II). After the polycondensation, the reaction liquid was separated into a lower water layer and an upper xylene solution layer containing the silicone oligomer, which was recovered to provide a first xylene solution.

Compound (1)

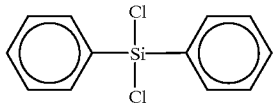

Compound (2)

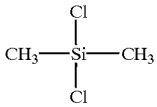

Compound (3)

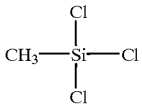

Separately, 15 mol parts of Compound (4) and 15 mol parts of Compound (5), respectively shown below, were dissolved in xylene and, into the resultant xylene solution, ca. 3 mol parts of an azo-type initiator (2,2'-azobisisobutyronitrile) was added to cause radical polymerization at a liquid temperature of 50–60° C., thereby forming a second xylene solution containing a copolymer of Compounds (4) and (5).

Compound (4)

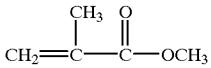

-continued

Compound (5)

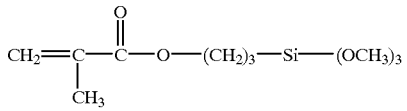

Then, the above-prepared first and second xylene solutions were blended with each other, and an additional amount of xylene was added to provide Coating Liquid No. 1 having a solid matter concentration of ca. 3 wt. %.

Magnetic ferrite particles (trade name: "F-400", available from POWDERTECH CO., LTD.) of 35 μm in average particle size, as magnetic carrier core particles, were placed in a fluidized bed state and coated with the above-prepared Coating Liquid No. 1 to obtain a coated magnetic carrier. Then, the coated magnetic carrier was heat-treated at 150° C. for 30 min. to promote the sticking of the silicone resin onto the surface of the magnetic ferrite core particles, thereby obtaining Magnetic Carrier No. 1 coated with 0.5 wt. % of silicone resin. Magnetic Carrier No. 1 thus obtained was subjected to surface analysis by ESCA, whereby the carrier showed a carbon content attributable to —COO— group (C in —COO—) of 39 atom. % relative to the amount of silicon constituting the silicone resin (Si in resin) (i.e., C(—COO—)/Si=39 atom. %) and a carbon content attributable to phenyl group (C in phenyl) of 112 atom. % relative to the carbon content attributable to —COO— group (i.e., C(phenyl)/C(—COO—)=112 atom. %.

Magnetic Carrier No. 1 was blended with a cyan toner, a magenta toner, a yellow toner and a black toner which were each a negatively chargeable non-magnetic toner having a weight-average particle size (D4) of ca. 8.5 μm and an agglomeratability of 10 %, suitable for use in a color laser copying machine ("CLC-700", made by Canon K.K.) to provide four two-component type developers including a cyan developer, a magenta developer, a yellow developer and a black developer each with a toner concentration of 6 wt. %.

The respective color developers were charged in a cyan developing device, a magenta developing device, a yellow developing device and a black developing device, respectively, of the color laser copying machine ("CLC-700") having an OPC photosensitive drum and including a reversal development mode developing system for developing a digital electrostatic image while applying an AC bias voltage to the developing sleeve, and subjected to continuous copying on $5\times10^4$ sheets by a mono-color copying mode for each color while replenishing the respective color toners in an environment of normal temperature/normal humidity (23° C. /60% RH) by using an original having an image area percentage of 25%. As a result, the respective developers exhibited little image density change, provided images free from fog, exhibited almost no chargeability change and caused almost no toner particle size change during the continuous image formation, thus exhibiting excellent continuous image forming characteristics. The respective developers showed triboelectric chargeabilities of −27 μC/g (cyan), −26 μC/g (magenta), −28 μC/g (yellow) and −23 μC/g (black). The respective developers showed excellent chargeability with little chargeability difference between environments of high temperature/high humidity (30° C./80% RH) and low temperature/low humidity (15° C./10% RH) and were completely free from image flow on the photosensitive drum which is generally noticeable in a high humidity environment.

The results are shown in Table 3 together with those of the other Examples and Comparative Examples.

EXAMPLE 2

Magnetic Carrier No. 2 was prepared in the same manner as in Example 1 except for using Coating Liquid No. 2 having a different composition shown in Table 1. Magnetic Carrier No. 2 provided ESCA charts of FIGS. 4–7 and ESCA analysis data shown in Table 2. By using Magnetic Carrier No. 2 otherwise in the same manner as in Example 1, the respective color developers were prepared and evaluated.

The results are shown in Table 3. The respective color developers exhibited slight changes in image density and chargeability after $5\times10^4$ sheets of continuous copying, but exhibited generally good performances.

EXAMPLE 3

Magnetic Carrier No. 3 was prepared in the same manner as in Example 1 except for using Coating Liquid No. 3 having a different composition shown in Table 1. Magnetic Carrier No. 3 provided ESCA analysis data shown in Table 2. By using Magnetic Carrier No. 3 otherwise in the same manner as in Example 1, the respective color developers were prepared and evaluated.

The results are shown in Table 3. The respective color developers gave images with slight fog and a slight particle size change of toner in the developing device after $5\times10^4$ sheets of continuous copying, but exhibited generally good performances.

COMPARATIVE EXAMPLE 1

Comparative Magnetic Carrier No. 1 was prepared in the same manner as in Example 1 except for using Coating Liquid No. 4 having a different composition shown in Table 1. Comparative Magnetic Carrier No. 1 provided ESCA analysis data shown in Table 2. By using Comparative Magnetic Carrier No. 1 otherwise in the same manner as in Example 1, the respective color developers were prepared and evaluated.

The results are shown in Table 3. The developers exhibited inferior results regarding the image density change and chargeability change after copying on $5\times10^4$ sheets, thus failing to show stable continuous image formation performances. Further, the developers exhibited inferior chargeability including a large chargeability change depending on environments. This may be attributable to a small C(phenyl)/C(—COO—) ratio resulting in insufficient charge diffusion causing charge accumulation.

COMPARATIVE EXAMPLE 2

Comparative Magnetic Carrier No. 2 was prepared in the same manner as in Example 1 except for using Coating Liquid No. 5 having a different composition shown in Table 1. Comparative Magnetic Carrier No. 2 provided ESCA analysis data shown in Table 2. By using Comparative Magnetic Carrier No. 2 otherwise in the same manner as in Example 1, the respective color developers were prepared and evaluated.

The results are shown in Table 3. The developers exhibited inferior results regarding image density change, chargeability change and fog after $5\times10^4$ sheets, thus failing to show stable continuous image formation characteristic. The toner particle size was changed after the continuous image formation.

COMPARATIVE EXAMPLE 3

Comparative Magnetic Carrier No. 3 was prepared in the same manner as in Example 1 except for using Coating Liquid No. 6 having a different composition shown in Table 1. Comparative Magnetic Carrier No. 3 provided ESCA analysis data shown in Table 2. By using Comparative Magnetic Carrier No. 3 otherwise in the same manner as in Example 1, the respective color developers were prepared and evaluated.

The results are shown in Table 3. The developers exhibited inferior continuous image forming stability including inferior fog and chargeability change after $5\times10^4$ sheets, and caused image flow on the photosensitive drum.

COMPARATIVE EXAMPLE 4

Comparative Magnetic Carrier No. 4 was prepared in the same manner as in Example 1 except for using Coating Liquid No. 7 having a different composition shown in Table 1. Comparative Magnetic Carrier No. 4 provided ESCA analysis data shown in Table 2. By using Comparative Magnetic Carrier No. 4 otherwise in the same manner as in Example 1, the respective color developers were prepared and evaluated.

The results are shown in Table 3. The developers exhibited inferior results regarding the chargeability change and fog after copying on $5\times10^4$ sheets, thus failing to show stable continuous image formation performances. Further, the developers exhibited inferior chargeability including a large chargeability change depending on environments. This may be attributable to a small C(—COO—)/Si ratio resulting in insufficient charge-imparting ability.

COMPARATIVE EXAMPLE 5

Comparative Magnetic Carrier No. 5 was prepared in the same manner as in Example 1 except for using Coating Liquid No. 8 having a different composition containing no Compound (4) or (5) as shown in Table 1. Comparative Magnetic Carrier No. 5 provided ESCA analysis data shown in Table 2. By using Comparative Magnetic Carrier No. 5 otherwise in the same manner as in Example 1, the respective color developers were prepared and evaluated.

The results are shown in Table 3.

COMPARATIVE EXAMPLE 6

Comparative Magnetic Carrier No. 6 was prepared in the same manner as in Example 1 except for using Coating Liquid No. 9 having a different composition not containing the Compound (1) as shown in Table 1. Comparative Magnetic Carrier No. 6 provided ESCA analysis data shown in Table 2. By using Comparative Magnetic Carrier No. 6 otherwise in the same manner as in Example 1, the respective color developers were prepared and evaluated.

The results are shown in Table 3.

TABLE 1

| Coating liquid | Compound (mol. parts) | | | | |
|---|---|---|---|---|---|
| Nos. | (1) | (2) | (3) | (4) | (5) |
| 1 | 25 | 23 | 2 | 20 | 30 |
| 2 | 19 | 5 | 6 | 30 | 40 |
| 3 | 25 | 30 | 5 | 15 | 15 |
| 4 | 5 | 43 | 2 | 25 | 25 |
| 5 | 48 | 0 | 2 | 20 | 30 |
| 6 | 20 | 3 | 2 | 35 | 40 |
| 7 | 10 | 65 | 5 | 10 | 10 |
| 8 | 48 | 50 | 2 | 0 | 0 |
| 9 | 0 | 45 | 5 | 20 | 30 |

TABLE 2

| Magnetic carrier | ESCA analysis data for coating silicone resin at magnetic carrier surface: (C in —COO—)/Si × 100 (atom. %) | (C in phenyl)/(C in —COO—) × 100 (atom. %) |
|---|---|---|
| No. 1 | 39.0 | 112.0 |
| No. 2 | 63.0 | 11. 1 |
| No. 3 | 15.0 | 268.0 |
| Comp. | | |
| No. 1 | 38.0 | 0.05 |
| No. 2 | 41.0 | 321.0 |
| No. 3 | 78.0 | 3 |
| No. 4 | 7.0 | 107.0 |
| No. 5 | 0 | — |
| No. 6 | 43.0 | 0 |

TABLE 3

| Ex. or Comp. Ex. | | Image density | | Image Fog | | Chargeability change | | Toner size | Image flow or photosensitive drum (30° C./80%) | |
|---|---|---|---|---|---|---|---|---|---|---|
| | | Initial | Final | Initial | Final | Environment | Final | charge (final) | Initial | Final |
| Ex. 1 | cyan | A | A | A | A | A | A | A | A | A |
| | magenta | A | A | A | A | A | A | A | A | A |
| | yellow | A | A | A | A | A | A | A | A | A |
| | black | A | A | A | A | A | A | A | A | A |
| Ex. 2 | cyan | A | B | A | A | A | B | A | A | A |
| | magenta | A | B | A | A | A | B | B | A | A |
| | yellow | A | A | A | A | A | A | A | A | A |
| | black | A | B | A | A | A | B | B | A | A |
| Ex. 3 | cyan | A | A | A | B | A | A | B | A | A |
| | magenta | A | A | A | B | A | A | B | A | A |
| | yellow | A | A | A | B | A | A | B | A | A |

TABLE 3-continued

| Ex. or Comp. Ex. | | Image density Initial | Image density Final | Image Fog Initial | Image Fog Final | Chargeability change Environment | Chargeability change Final | Toner size charge (final) | Image flow or photosensitive drum (30° C./80%) Initial | Image flow or photosensitive drum (30° C./80%) Final |
|---|---|---|---|---|---|---|---|---|---|---|
| | black | A | A | A | B | A | A | B | A | A |
| Comp. | cyan | A | C | A | B | C | D | B | A | B |
| Ex. 1 | magenta | A | C | A | C | C | D | B | A | B |
| | yellow | A | C | A | B | C | D | B | A | B |
| | black | A | D | A | C | D | D | B | A | B |
| Comp. | cyan | A | C | A | C | B | C | D | A | B |
| Ex. 2 | magenta | A | C | A | C | B | C | D | A | B |
| | yellow | A | C | A | C | B | C | D | A | B |
| | black | A | D | A | D | C | C | D | A | B |
| Comp. | cyan | A | B | A | C | B | C | B | B | D |
| Ex. 3 | magenta | A | C | A | C | B | C | B | B | D |
| | yellow | A | B | A | C | B | C | B | B | D |
| | black | A | C | A | D | B | C | B | B | D |
| Comp. | cyan | B | C | B | D | D | B | B | A | B |
| Ex. 4 | magenta | B | D | B | D | D | C | C | A | A |
| | yellow | B | D | B | D | D | C | B | A | B |
| | black | B | C | B | D | D | B | B | A | B |
| Comp. | cyan | B | D | B | D | D | C | D | A | B |
| Ex. 5 | magenta | C | D | B | D | D | C | D | A | B |
| | yellow | C | D | B | D | D | D | D | A | B |
| | black | C | D | B | D | D | D | D | A | B |
| Comp. | cyan | A | D | A | C | D | D | C | A | B |
| Ex. 6 | magenta | A | D | A | C | D | D | B | A | B |
| | yellow | A | D | A | D | D | D | C | A | B |
| | black | A | D | A | D | D | D | C | A | B |

Evaluation Methods

1) Image Density

The image densities of solid image portions of images formed under proper exposure conditions were measured by using a Macbeth densitometer and evaluated at four levels according to the following standard.

A: The original density is very well reproduced without density irregularity.

B: The original density is reproduced at a level of practically no problem.

C: Ununiform and density irregularity are observed at a practically problematic level.

D: A large difference from the original density is observed at a practically unacceptable level.

2) Fog on Images

Toner fog on a white background portion is measured by using a reflectometer ("MODEL TC-6DS", available from Tokyo Denshoku K.K.) and evaluated at four levels according to the following standard.

A: below 0.5%

B: 0.5% to below 1.5%

C: 1.5% to below 2.5%

D: 2.5% or larger

3) Chargeability Change Due to Environmental Condition Change

A sample developer is placed in a 50 ml-polyethylene bottle, and then the bottle is left standing for one day and shaked 500 time by hands in an environment of 15° C. and 10% RH. The standing and shaking are repeated for another but identical developer sample in an environment of 30° C. and 80% RH. The two developer samples are respectively subjected a triboelectric chargeability measurement described later to obtain triboelectric charges Q (LL) and Q (HH) of the toner in the developer corresponding to the different environmental conditions. Based on a chargeability difference ΔQ (=Q(LL)−Q(HH)), the evaluation is performed according to the following standard.

A: $\Delta Q<10\ \mu C/g$

B: $10\ \mu C/g \leqq \Delta Q<15\ \mu C/g$

C: $15\ \mu C/g \leqq \Delta Q<20\ \mu C/g$

D: $20\ \mu C/g \leqq \Delta Q$

4) Chargeability Change During Continuous Image Formation

Continuous image formation is performed in an environment of 23° C. and 60% RH, and a developer sample is taken from the developing sleeve surface in the developing device at an initial stage and a final stage (after $5\times10^4$ sheets), respectively. The two developer samples are subjected to a triboelectric chargeability measurement described later to obtain an initial stage charge Q (initial) and a final stage charge Q (final) and, based on a charge difference ΔQ (=Q(initial)−Q(final)), the evaluation is performed according to the following standard.

A: $\Delta Q \leqq 5\ \mu C/g$

B: $5\ \mu C/g \leqq \Delta Q<10\ \mu C/g$

C: $10\ \mu C/g \leqq \Delta Q<15\ \mu C/g$

D: $15\ \mu C/g \leqq \Delta Q$

5) Toner Particle Size Change During Continuous Image Formation

Continuous image formation is performed in an environment of 23° C. and 50% RH and, a toner sample is taken from a developer in the developing device at an initial stage and a final stage (after $5\times10^4$ sheets), respectively. The two toner samples are subjected to a particle size distribution measurement in the manner described hereinbefore to obtain an initial stage weight-average particle size D (initial) and a final stage weight-average particle size D (final). Based on a difference therebetween ΔD (=D (initial)−D (final)), the evaluation is performed according to the following standard:

A: $\Delta D<1\ \mu m$

B: $1\ \mu m \leqq \Delta D \leqq 2\ \mu m$

C: $2\ \mu m \leqq \Delta D \leqq 3\ \mu m$

D: $3\ \mu m \leqq \Delta D$

6) Image Flow on a Photosensitive Drum

A halftone image is formed in an environment of 30° C. and 60% RH by using a color laser copying machine ("CLC 700") and evaluated with respect to image quality according to the following standard.

A: No image flow observed at all.

B: Slight image flow at a level of practically no problems

C: Image flow at a practically problematic level.

D: Image flow is observed on an entire image at a practically unacceptable level.

7) Chargeability Measurement

Figure 3:
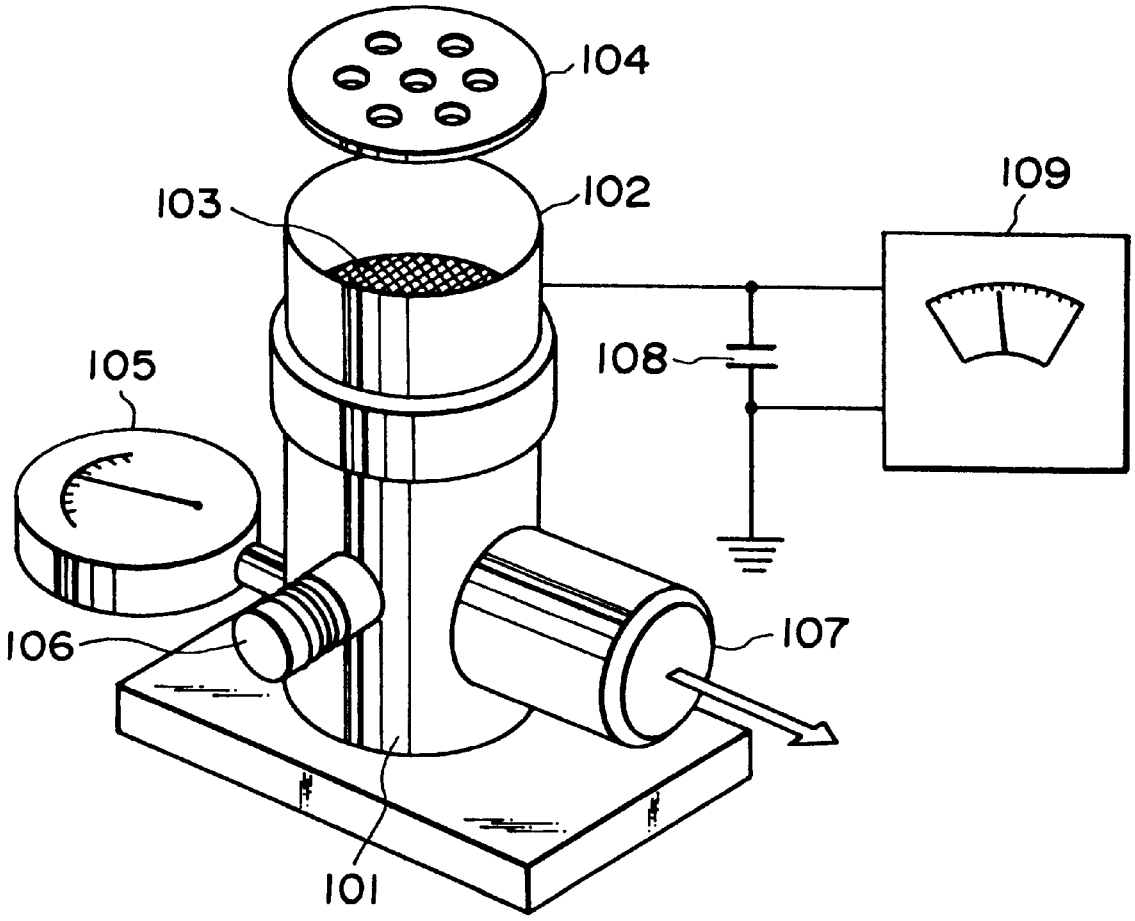
FIG. 3 is an illustration of an apparatus for measuring a triboelectric charge of a toner in a two-component type developer.

A triboelectric charge of a toner in a developer is measured by using an apparatus as shown in FIG. 3. Referring to FIG. 3, ca. 0.5–0.9 g of a developer sample is placed in a metal measurement vessel 102 provided with a 500-mesh screen 103 at a bottom and is covered with a metal lid 104. At this time, the entire measurement vessel 2 is weight at $W_1$ (g). Then, the developer is sucked through an spirator 101 (of which at least a portion contacting the vessel 102 is composed of an insulating material, and a suction port 107 connected to a vacuum system (not shown) while adjusting a control valve 106 to provide a pressure of 250 mmAq. at a vacuum gauge 105. In this state, the toner is sufficiently removed by suction, preferably by suction for ca. 2 min. Thereafter, a potential meter 109 connected via a capacitor 108 having a capacitance C (μF) is read at a potential of V (volts). After the suction, the entire measurement vessel is weighed at $W_2$ (g). From these values, the triboelectric charge Q (μC/g) of the toner is calculated by the following equation:

$$Q\ (\mu C/g)=(C\times V)/(W_1=W_2).$$

EXAMPLE 4

Cyan Toner Preparation

Polyester resin formed by polycondensation of propoxidized bisphenol and fumaric acid (binder resin, Mw=25,000) 100 wt.parts Phthalocyanine pigment 4 wt.parts (cyan colorant)

Chromium di-tert-butylsalicylate 4 wt.parts (negative charge control agent)

The above ingredients were sufficiently preliminarily blended by a Henschel mixer and melt-kneaded through a twin screw extruder. After cooling, the melt-kneaded product was coarsely pulverized by a hammer mill into ca. 1–2 mm and then finely pulverized by an air jet pulverizer, followed by classification to recover negatively chargeable non-magnetic cyan toner particles having a weight-average particle size (D4) of ca. 5.8 μm. Then, 100 wt. parts of the thus-obtained non-magnetic cyan toner particles was blended with 1.5 wt. parts of hydrophobic titanium oxide fine powder ($S_{BET}$ (BET specific surface area)=100 $m^2/g$) to prepare a negatively chargeable cyan toner.

Magenta Toner Preparation

Negatively chargeable non-magnetic magenta toner particles (D4=ca. 5.8 μm) were prepared in the same manner as the preparation of the above-mentioned cyan toner particles except for using a quinacridone-type magenta pigment instead of the phthalocyanine pigment. Then, 100 wt. parts of the non-magnetic magenta toner particles were blended with 1.5 wt. parts of hydrophobic titanium oxide fine powder ($S_{BET}$=100 $m^2/g$) to obtain a negatively chargeable magenta toner.

Yellow Toner Preparation

Negatively chargeable non-magnetic yellow toner particles (D4=ca. 5.8 μm) were prepared in the same manner as the preparation of the above-mentioned cyan toner particles except for using a yellow colorant (C.I. Pigment Yellow 17) instead of the phthalocyanine pigment. Then, 100 wt. parts of the non-magnetic yellow toner particles were blended with 1.5 wt. parts of hydrophobic titanium oxide fine powder ($S_{BET}$=100 $m^2/g$) to obtain a negatively chargeable yellow toner.

Black Toner Preparation

Negatively chargeable non-magnetic black toner particles (D4=ca. 5.8 μm) were prepared in the same manner as the preparation of the above-mentioned cyan toner particles except for using carbon black instead of the phthalocyanine pigment. Then, 100 wt. parts of the non-magnetic black toner particles were blended with 1.3 wt. parts of hydrophobic titanium oxide fine powder ($S_{BET}$=100 $m^2/g$) to obtain a negatively chargeable black toner.

6 wt. parts each the above-prepared respective color toners each of a small particle size-type were respectively blended with 94 wt. parts of Magnetic Carrier No. 1 prepared in Example 1 to prepare four colors of two-component type developers. The respective color developers were subjected to continuous image formation in a mono-color mode while replenishing the respective color toners as desired in the same manner as in Example 1. The results are shown in Table 4. In a normal temperature/normal humidity environment, the respective developers showed toner triboelectric chargeabilities of −34 μC/g (for cyan), −33 μC/g (for magenta), −35 μC/g (for yellow) and −32 μC/g (for black).

EXAMPLES 5–6 COMPARATIVE EXAMPLES 7–12

Eight types of two-component type developers each in four colors were prepared and evaluated by continuous image formation in the same manner as in Example 4 except for using Magnetic Carriers Nos. 2 and 3, and Comparative Magnetic Carriers Nos. 1–6, respectively, instead of Magnetic Carrier No. 1. The results are inclusively shown in Table 4.

TABLE 4

| | | Image density | | Image Fog | | Chargeability change | | Toner size | Image flow or photo-sensitive drum (30° C./80%) | |
|---|---|---|---|---|---|---|---|---|---|---|
| Ex. or Comp. Ex. | | Initial | Final | Initial | Final | Environ-ment | Final | charge (final) | Initial | Final |
| Ex. 4 | cyan | A | A | A | A | A | A | A | A | A |
| | magenta | A | A | A | A | A | A | A | A | A |
| | yellow | A | A | A | A | A | A | A | A | A |
| | black | A | A | A | A | A | A | A | A | A |

TABLE 4-continued

| Ex. or Comp. Ex. | | Image density Initial | Image density Final | Image Fog Initial | Image Fog Final | Chargeability change Environment | Chargeability change Final | Toner size charge (final) | Image flow or photosensitive drum (30° C./80%) Initial | Image flow or photosensitive drum (30° C./80%) Final |
|---|---|---|---|---|---|---|---|---|---|---|
| Ex. 5 | cyan | A | A | A | A | A | A | A | A | A |
| | magenta | A | A | A | A | A | B | A | A | A |
| | yellow | A | A | A | A | A | B | A | A | A |
| | black | A | A | A | A | A | A | A | A | A |
| Ex. 6 | cyan | A | B | A | A | A | B | A | A | A |
| | magenta | A | B | A | A | A | A | A | A | A |
| | yellow | A | A | A | B | A | A | B | A | A |
| | black | A | A | A | B | A | A | B | A | A |
| Comp. Ex. 7 | cyan | A | C | A | D | C | D | C | A | B |
| | magenta | A | C | A | D | C | C | C | A | B |
| | yellow | A | C | A | D | C | D | C | A | B |
| | black | A | C | A | D | C | D | C | A | B |
| Comp. Ex. 8 | cyan | A | C | A | D | B | C | D | A | B |
| | magenta | A | C | A | D | B | C | D | A | B |
| | yellow | A | C | A | D | B | C | D | A | B |
| | black | A | D | A | D | B | C | D | A | B |
| Comp. Ex. 9 | cyan | A | C | A | D | B | C | C | B | D |
| | magenta | A | C | A | D | B | C | C | B | D |
| | yellow | A | C | A | D | C | C | C | B | D |
| | black | A | C | A | D | B | C | C | B | D |
| Comp. Ex. 10 | cyan | B | C | B | D | D | C | C | A | B |
| | magenta | B | C | B | D | D | C | C | A | B |
| | yellow | B | D | B | D | D | C | C | A | B |
| | black | B | C | B | D | D | C | C | A | B |
| Comp. Ex. 11 | cyan | C | D | B | D | D | D | D | A | B |
| | magenta | C | D | C | D | D | D | D | A | B |
| | yellow | C | D | C | D | D | D | D | A | B |
| | black | C | D | C | D | D | D | D | A | B |
| Comp. Ex. 12 | cyan | A | D | A | D | D | D | C | A | B |
| | magenta | A | D | A | D | D | D | C | A | B |
| | yellow | A | D | A | D | D | D | C | A | B |
| | black | A | D | A | D | D | D | C | A | B |

EXAMPLE 7

A coating liquid for forming a surface-coating layer onto magnetic carrier core particles was prepared in the following manner.

28 mol parts of Compound (1), 37 mol parts of Compound (2), 2 mol parts of Compound (3), and 3 mol parts of Compound (8) shown below, were dissolved in xylene and the resultant xylene solution was added dropwise into a vessel containing warm water at 70–80° C. to cause polycondensation of the silicone compounds, thereby forming a silicone oligomer having the above-mentioned structural units (I) and (II). After the polycondensation, the reaction liquid was separated into a lower water layer and an upper xylene solution layer containing the silicone oligomer having a nitrogen-containing group, which was recovered to provide a third xylene solution.

Compound (8)

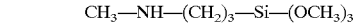

$$CH_3—NH—(CH_2)_3—Si—(OCH_3)_3$$

Then, a second xylene solution of a copolymer of Compounds (4) and (5) prepared in the same manner as in Example 1 and the above-prepared third xylene solution were blended with each other, and an additional amount of xylene was added to provide Coating Liquid No. 10 having a solid matter concentration of ca. 3 wt. %.

Magnetic ferrite particles (trade name: "F-400", available from POWDERTECH CO., LTD.) of 35 μm in average particle size, as magnetic carrier core particles, were placed in a fluidized bed state and coated with the above-prepared Coating Liquid No. 10 to obtain a coated magnetic carrier. Then, the coated magnetic carrier was heat-treated at 150° C. for 30 min. to promote the sticking of the silicone resin onto the surface of the magnetic ferrite core particles, thereby obtaining Magnetic Carrier No. 4 coated with 1.0 wt. % of silicone resin. Magnetic Carrier No. 4 thus obtained was subjected to surface analysis by ESCA, whereby the carrier showed a carbon content attributable to —COO— group (C in —COO—) of 40 atom. % relative to the amount of silicon constituting the silicone resin (Si in resin) (i.e., C(—COO—)/Si=39 atom. %) and a nitrogen content attributable to nitrogen-containing group (N) of 1 atom. % relative to the carbon content attributable to —COO— group (i.e., N/C(—COO—)=1 atom. %.

Two-component type developers for four colors were prepared in the same manner as in Example 1 except for using Magnetic Carrier No. 4 instead of Magnetic Carrier No. 1, and evaluated by continuous image formation in the same manner as in Example 1. The results are shown in Table 7 together with those of Examples and Comparative Examples described later.

As a result, the developers exhibited little image density change, provided fog-free image and exhibited almost no chargeability change during the continuous image formation, thus exhibiting excellent continuous image forming characteristics. Further, the developers showed excellent chargeability characteristics inclusive of little chargeability change between environments of high temperature/high humidity and low temperature/low humidity and were completely free from image flow on the photosensitive drum which is liable to be noticeable in a high humidity environment.

EXAMPLE 8

Magnetic Carrier No. 5 was prepared in the same manner as in Example 7 except for using Coating Liquid No. 11 having a different compositions as shown in Table 5, and provided ESCA analysis data shown in Table 6. By using Magnetic Carrier No. 5 otherwise in the same manner as in Example 1, the respective color developers were prepared and evaluated in the same manner as in Example 1. The results are shown in Table 7.

The developers exhibited slight changes in image density and chargeability after continuous image formation on $5\times10^4$ sheets but exhibited generally suitable level of performances.

EXAMPLE 9

Magnetic Carrier No. 6 was prepared in the same manner as in Example 7 except for using Coating Liquid No. 12 having a different compositions as shown in Table 5 including Compound (9) shown below instead of Compound (8)

Compound (9)

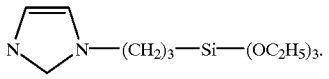

Magnetic Carrier No. 6 provided ESCA analysis data shown in Table 6. By using Magnetic Carrier No. 6 otherwise in the same manner as in Example 1, the respective color developers were prepared and evaluated in the same manner as in Example 1. The results are shown in Table 7.

The developers exhibited slight changes in image density and chargeability after continuous image formation on $5\times10^4$ sheets but exhibited generally suitable level of performances.

COMPARATIVE EXAMPLES 13–18

Comparative Magnetic Carriers Nos. 7–11 giving ESCA analysis data shown in Table 6 were prepared in the same manner as in Example 7 except for using Coating Liquids Nos. 13–17 having different compositions as shown in Table 5.

Six types of two-component type developers each in four colors were prepared by using Comparative Magnetic Carriers Nos. 8–11 otherwise in the same manner as in Example 1 and evaluated by continuous image formation in the same manner as in Example 1.

In Comparative Example 13, the developers exhibited inferior results regarding the image density change, chargeability change and fog after copying on $5\times10^4$ sheets, thus failing to show stable continuous image formation performances. Further, the developers exhibited inferior chargeability including a large chargeability change depending on environments. This may be attributable to a small C(—COO—)/Si ratio resulting in insufficient charge-imparting ability.

In Comparative Example 14, the developers exhibited inferior results regarding image density change, chargeability change and fog after $5\times10^4$ sheets, thus failing to show stable continuous image formation characteristic. The image flow on the photosensitive drum was also inferior.

In Comparative Example 16, the developers exhibited inferior results regarding the image density change and chargeability change and also remarkably inferior fog after copying on $5\times10^4$ sheets, thus failing to show stable continuous image formation performance. This may be attributable to a large N/C(—COO—) ratio resulting in insufficient charge diffusion causing charge accumulation.

In Comparative Example 15, the developers exhibited inferior results regarding the image density change and chargeability change and also remarkable inferior fog after copying on $5\times10^4$ sheets, thus failing to show stable continuous image formation performances. This may be attributable to a small N/C(—COO—) ratio resulting in insufficient charging speed and charge-imparting ability.

TABLE 5

| Coating liquid | Compound (mol. parts) | | | | | | | | |
|---|---|---|---|---|---|---|---|---|---|
| Nos. | (1) | (2) | (3) | (4) | (5) | (6) | (7) | (8) | (9) |
| 10 | 25 | 15 | 5 | 20 | 30 | 0 | 0 | 5 | 0 |
| 11 | 15 | 10 | 5 | 25 | 45 | 0 | 0 | 1 | 0 |
| 12 | 25 | 25 | 5 | 15 | 20 | 0 | 0 | 0 | 10 |
| 13 | 10 | 63 | 5 | 10 | 10 | 0 | 0 | 0 | 2 |
| 14 | 18 | 3 | 2 | 30 | 40 | 0 | 0 | 0 | 7 |
| 15 | 25 | 5 | 5 | 20 | 30 | 0 | 0 | 15 | 0 |
| 16 | 25 | 15 | 49 | 20 | 30 | 0 | 0 | 0 | 0.1 |
| 17 | 48 | 50 | 1 | 0 | 0 | 0 | 0 | 1 | 0 |

TABLE 6

| Magnetic carrier | ESCA analysis data for coating silicone resin at magnetic carrier surface | | |
|---|---|---|---|
| | $\frac{\text{C in —COO—}}{\text{Si}}\times100$ (atm. %) | $\frac{\text{N}}{\text{C in —COO—}}\times100$ (atm. %) | $\frac{\text{C in phenyl}}{\text{C in —COO—}}\times100$ (atm. %) |
| No. | | | |
| 4 | 40.0 | 1.0 | 102.0 |
| 5 | 60.0 | 0.05 | 0.8 |
| 6 | 20.0 | 8.0 | 251.0 |
| Comparative No. | | | |
| 7 | 5.0 | 1.0 | 95.0 |
| 8 | 85.0 | 1.0 | 2.0 |
| 9 | 42.0 | 13.0 | 110.0 |

TABLE 6-continued

| Magnetic carrier | ESCA analysis data for coating silicone resin at magnetic carrier surface | | |
|---|---|---|---|
| | $\frac{\text{C in —COO—}}{\text{Si}} \times 100$ (atm. %) | $\frac{\text{N}}{\text{C in —COO—}} \times 100$ (atm. %) | $\frac{\text{C in phenyl}}{\text{C in —COO—}} \times 100$ (atm. %) |
| 10 | 35.0 | 0.005 | 108.0 |
| 11 | 0 | — | — |

TABLE 7

| Ex. or Comp. Ex. | | Image density | | Image Fog | | Chargeability change | | Toner size | Image flow or photo-sensitive drum (30° C./80%) | |
|---|---|---|---|---|---|---|---|---|---|---|
| | | Initial | Final | Initial | Final | Environ-ment | Final | charge (final) | Initial | Final |
| Ex. 7 | cyan | A | A | A | A | A | A | A | A | A |
| | magenta | A | A | A | A | A | A | A | A | A |
| | yellow | A | A | A | A | A | A | A | A | A |
| | black | A | A | A | A | A | A | A | A | A |
| Ex. 8 | cyan | A | B | A | A | A | B | A | A | A |
| | magenta | A | A | A | A | A | A | A | A | A |
| | yellow | A | A | A | A | A | B | A | A | A |
| | black | A | B | A | A | A | B | A | A | A |
| Ex. 9 | cyan | A | B | A | A | A | B | A | A | A |
| | magenta | A | B | A | A | A | B | A | A | A |
| | yellow | A | B | A | A | A | B | A | A | A |
| | black | A | B | A | A | A | B | B | A | A |
| Comp. | cyan | B | C | A | C | D | C | B | A | B |
| Ex. 13 | magenta | B | B | B | C | D | C | B | A | B |
| | yellow | B | C | A | C | D | C | B | A | B |
| | black | B | C | A | C | D | C | B | A | B |
| Comp. | cyan | A | C | A | C | B | C | B | B | D |
| Ex. 14 | magenta | A | C | A | C | B | C | B | B | D |
| | yellow | A | C | A | C | B | C | B | B | D |
| | black | A | D | A | C | B | C | B | B | D |
| Comp. | cyan | A | D | A | B | B | D | C | A | B |
| Ex. 15 | magenta | A | D | A | B | B | D | B | A | B |
| | yellow | A | D | A | B | B | D | B | A | B |
| | black | A | D | A | B | B | D | B | A | B |
| Comp. | cyan | A | C | B | D | B | B | B | A | B |
| Ex. 16 | magenta | A | D | B | D | C | B | B | A | B |
| | yellow | A | C | B | D | B | B | B | A | B |
| | black | A | C | B | D | C | B | B | A | B |
| Comp. | cyan | A | D | B | D | C | C | B | A | B |
| Ex. 17 | magenta | A | D | B | D | C | C | B | A | B |
| | yellow | A | D | B | D | C | C | B | A | B |
| | black | A | D | B | D | C | C | B | A | B |

EXAMPLES 10–12 AND COMPARATIVE EXAMPLES 19–23

Eight types of two-component type developers each in four colors were prepared by using the four color toners each having a small weight-average particle size of 5.8 μm prepared in Example 4 in combination with Magnetic Carriers Nos. 4–6 and Comparative Magnetic Carriers Nos. 7–11. The developers were evaluated by continuous image formation in the same manner as in Example 1. The results are inclusively shown in Table 8.

TABLE 8

| Ex. or Comp. Ex. | | Image density Initial | Image density Final | Image Fog Initial | Image Fog Final | Chargeability change Environment | Chargeability change Final | Toner size charge (final) | Image flow or photosensitive drum (30° C./80%) Initial | Image flow or photosensitive drum (30° C./80%) Final |
|---|---|---|---|---|---|---|---|---|---|---|
| Ex. 10 | cyan | A | A | A | A | A | A | A | A | A |
| | magenta | A | A | A | A | A | A | A | A | A |
| | yellow | A | A | A | A | A | A | A | A | A |
| | black | A | A | A | A | A | A | A | A | A |
| Ex. 11 | cyan | A | B | A | A | A | B | A | A | A |
| | magenta | A | B | A | A | A | B | A | A | A |
| | yellow | A | B | A | A | A | B | A | A | A |
| | black | A | B | A | A | A | B | A | A | A |
| Ex. 12 | cyan | A | B | A | A | A | B | B | A | A |
| | magenta | A | B | A | A | A | B | B | A | A |
| | yellow | A | B | A | A | A | B | B | A | A |
| | black | A | B | A | A | A | B | B | A | A |
| Comp. Ex. 19 | cyan | B | C | B | D | D | C | C | A | B |
| | magenta | B | C | B | D | D | C | C | A | B |
| | yellow | B | C | B | D | D | C | C | A | B |
| | black | B | C | B | D | D | C | C | A | B |
| Comp. Ex. 20 | cyan | A | C | A | D | B | C | C | B | D |
| | magenta | A | C | A | D | B | D | C | B | D |
| | yellow | A | C | A | D | B | C | C | B | D |
| | black | A | C | A | D | B | C | C | B | D |
| Comp. Ex. 21 | cyan | A | D | A | C | C | D | D | A | B |
| | magenta | A | D | A | C | C | D | C | A | B |
| | yellow | A | D | A | C | C | D | C | A | B |
| | black | A | D | A | C | C | D | C | A | B |
| Comp. Ex. 22 | cyan | A | D | B | D | C | B | C | A | B |
| | magenta | A | D | B | D | C | B | C | A | B |
| | yellow | A | D | B | D | C | B | C | A | B |
| | black | A | D | B | D | C | B | C | A | B |
| Comp. Ex. 23 | cyan | A | D | B | D | C | D | C | A | B |
| | magenta | A | D | B | D | C | D | C | A | B |
| | yellow | A | D | B | D | C | D | C | A | B |
| | black | A | D | B | D | C | D | A | B | |

What is claimed is:

1. A magnetic carrier for use in an electrophotographic developer, comprising: magnetic carrier core particles and a silicone resin coating the magnetic carrier core particles; wherein the silicone resin is characterized by having (i) both (a) a —COO— group and (b) a phenyl group or nitrogen-containing group, (ii) a carbon content attributable to the —COO— group of 10–70 atomic % of silicon constituting the silicone resin, based on ESCA, and (iii) a carbon content attributable to the phenyl group of 0.1–300 atomic % or a nitrogen content attributable to the nitrogen-containing group of 0.01–10 atomic %, respectively, of the carbon content attributable to the —COO— group, based on ESCA.

2. The magnetic carrier according to claim 1, wherein the silicone resin has a carbon content attributable to —COO— group of 15–65 atomic % of silicon constituting the silicone resin, and a carbon content attributable to phenyl group of 10–200 atomic % of the carbon content attributable to —COO— group, based on ESCA.

3. The magnetic carrier according to claim 1, wherein the silicone resin has a carbon content attributable to —COO— group of 15–65 atomic % of silicon constituting the silicone resin, and a nitrogen content attributable to nitrogen-containing group of 0.1–5 atomic % of the carbon content attributable to —COO— group, based on ESCA.

4. The magnetic carrier according to claim 1, wherein the silicone resin has three functional groups of —COO— group, phenyl group and nitrogen-containing group; and has a carbon content attributable to —COO— group of 10–70 atomic % of silicon constituting the silicone resin, a carbon content attributable to phenyl group of 0.1–300 atomic % of the carbon content attributable to —COO—, and a nitrogen content attributable to the nitrogen-containing group of 0.01–10 atomic % of the carbon content attributable to —COO— group, based on ESCA.

5. The magnetic carrier according to claim 4, wherein the silicone resin has a carbon content attributable to —COO— group of 15–65 atomic % of silicon constituting the silicone resin, a carbon content attributable to phenyl group of 10–200 atomic % of the carbon content attributable to —COO—, and a nitrogen content attributable to the nitrogen-containing group of 0.1–5 atomic % of the carbon content attributable to —COO— group, based on ESCA.

6. The magnetic carrier according to claim 1, wherein the silicone resin has structural units of the following formula (I) and (II):

(I)

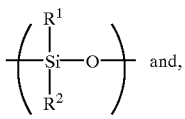

and,

-continued (II)

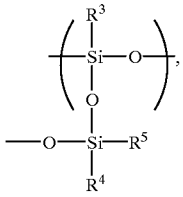

wherein $R^1$–$R^5$ independently are methyl, ethyl or phenyl, and the silicone resin also has an ester group and a phenyl group as functional group.

7. The magnetic carrier according to claim 1, wherein the silicone resin has structural units of the following formula (I) and (II):

(I)

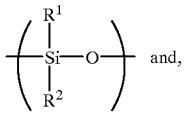

and, (II)

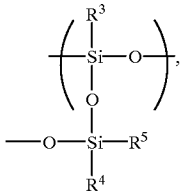

wherein $R^1$–$R^5$ independently are methyl, ethyl or phenyl, and the silicone resin also has an ester group and a nitrogen-containing group of the following formula (VII) or (VIII):

(VII)

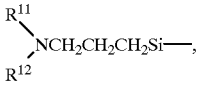

wherein $R^{11}$ and $R^{12}$ independently denote H, $CH_3$, $CH_2CH_2$ or (VIII)

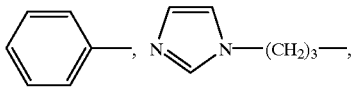

as functional groups.

8. The magnetic carrier according to claim 1, wherein the silicone resin has a phenyl group and an ester group originated from a compound of the following formula (VI):

(VI)

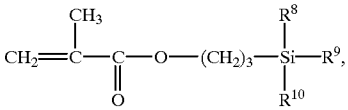

wherein $R^8$, $R^9$ and $R^{10}$ independently denote $CH_3$, $CH_2CH_3$, $OHC_3$ or $OCH_2CH_3$ provided that at least one of $R^8$, $R^9$ and $R^{10}$ is $OCH_3$ or $OCH_2CH_3$.

9. The magnetic carrier according to claim 1, wherein the silicone resin has a nitrogen-containing group and an ester group originated from a compound of the following formula (VI):

(VI)

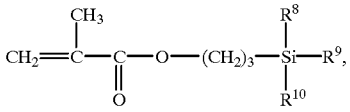

wherein $R^8$, $R^9$ and $R^{10}$ independently denote $CH_3$, $CH_2CH_3$, $OHC_3$ or $OCH_2CH_3$ provided that at least one of $R^8$, $R^9$ and $R^{10}$ is $OCH_3$ or $OCH_2CH_3$.

10. The magnetic carrier according to claim 1, wherein the silicone resin has an ester group originated from a copolymer of a methacrylate ester and a compound of the following formula (VI)

(VI)

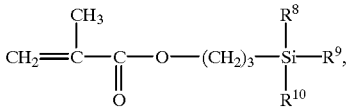

wherein $R^8$, $R^9$ and $R^{10}$ independently denote $CH_3$, $CH_2CH_3$, $OCH_3$ or $OCH_2CH_3$ provided that at least one of $R^8$, $R^9$ and $R^{10}$ is $OCH_3$ or $OCH_2CH_3$.

11. The magnetic carrier according to claim 1, wherein the silicone resin has an ester group originated from a copolymer of an acrylate ester and a compound of the following formula (VI)

(VI)

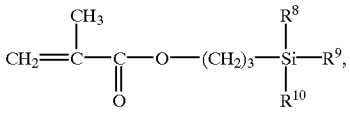

wherein $R^8$, $R^9$ and $R^{10}$ independently denote $CH_3$, $CH_2CH_3$, $OCH_3$ or $OCH_2CH_3$ provided that at least one of $R^8$, $R^9$ and $R^{10}$ is $OCH_3$ or $OCH_2CH_3$.

12. The magnetic carrier according to claim 1, wherein the magnetic carrier core particles are coated with 0.10–5.0 wt. % of the silicone resin.

13. The magnetic carrier according to claim 1, wherein the magnetic carrier core particles are coated with 0.15–2.0 wt. % of the silicone resin.

14. The magnetic carrier according to claim 1, wherein the magnetic carrier has an average particle size of 20–100 $\mu$m.

15. The magnetic carrier according to claim 1, wherein the magnetic carrier has an average particle size of 30–65 $\mu$m.

16. The magnetic carrier according to claim 1, wherein the magnetic carrier core particles after being coated with the silicone resin has been subjected to baking at 120–170° C. for promoting the adhesion of the silicone resin onto the core particles.

17. A two-component developer for developing an electrostatic image, comprising a toner and a magnetic carrier, wherein the magnetic carrier comprises magnetic carrier core particles and a silicone resin coating the magnetic carrier core particles; wherein the silicone resin is characterized by having (i) both (a) a —COO— group and (b) a phenyl group or nitrogen-containing group, (ii) a carbon content attributable to the —COO— group of 10–70 atomic % of silicon constituting the silicone resin, based on ESCA, and (iii) a carbon content attributable to the phenyl group of 0.1–300 atomic % or a nitrogen content attributable to the nitrogen-containing group of 0.01–10 atomic %, respectively, of the carbon content attributable to the —COO— group, based on ESCA and wherein the magnetic carrier is a magnetic carrier according to any one of claims 2–16.

18. An image forming method, comprising:

forming an electrostatic image on a photosensitive member, forming a magnetic brush of a two-component developer on a developer-carrying member enclosing a magnetic field generating means, and developing the electrostatic image with the magnetic brush formed on the developer-carrying member to form a toner image on the photosensitive member;

wherein the two-component developer comprises a toner and a magnetic carrier, the magnetic carrier comprises magnetic carrier core particles and a silicone resin coating the magnetic carrier core particles, and the silicone resin is characterized by having (i) both (a) a —COO— group and (b) a phenyl group or nitrogen-containing group, (ii) a carbon content attributable to the —COO— group of 10–70 atomic % of silicon constituting the silicone resin, based on ESCA, and (iii) a carbon content attributable to the phenyl group of 0.1–300 atomic % or a nitrogen content attributable to the nitrogen-containing group of 0.01–10 atomic %, respectively, of the carbon content attributable to the —COO— group, based on ESCA and wherein the magnetic carrier is a magnetic carrier according to any one of claims 2–16.

19. A two-component developer for developing an electrostatic image, comprising a toner and a magnetic carrier, wherein the magnetic carrier comprises magnetic carrier core particles and a silicone resin coating the magnetic carrier core particles; wherein the silicone resin is characterized by having (i) both (a) a —COO— group and (b) a phenyl group or nitrogen-containing group, (ii) a carbon content attributable to the —COO— group of 10–70 atomic % of silicon constituting the silicone resin, based on ESCA, and (iii) a carbon content attributable to the phenyl group of 0.1–300 atomic % or a nitrogen content attributable to the nitrogen-containing group of 0.01–10 atomic %, respectively, of the carbon content attributable to the —COO— group, based on ESCA.

20. The developer according to claim 19, wherein the toner has a negative chargeability relative to the magnetic carrier.

21. The developer according to claim 20, wherein the toner has a weight-average particle size of at most 9.0 μm, and the magnetic carrier has an average particle size of 20–100 μm.

22. The developer according to claim 20, wherein the toner has a weight-average particle size of 3.0–8.0 μm, and the magnetic carrier has an average particle size of 30–65 μm.

23. The developer according to claim 19, wherein the toner has a negative chargeability of −20 to −100 μC/g relative to the magnetic carrier.

24. The developer according to claim 19, wherein the toner has a negative chargeability of −30 to −60 μC/g relative to the magnetic carrier.

25. An image forming method, comprising:

forming an electrostatic image on a photosensitive member, forming a magnetic brush of a two-component developer on a developer-carrying member enclosing a magnetic field generating means, and developing the electrostatic image with the magnetic brush formed on the developer-carrying member to form a toner image on the photosensitive member;

wherein the two-component developer comprises a toner and a magnetic carrier, the magnetic carrier comprises magnetic carrier core particles and a silicone resin coating the magnetic carrier core particles, and the silicone resin is characterized by having (i) both (a) a —COO— group and (b) a phenyl group or nitrogen-containing group, (ii) a carbon content attributable to the —COO— group of 10–70 atomic % of silicon constituting the silicone resin, based on ESCA, and (iii) a carbon content attributable to the phenyl group of 0.1–300 atomic % or a nitrogen content attributable to the nitrogen-containing group of 0.01–10 atomic %, respectively, of the carbon content attributable to the —COO— group, based on ESCA.

26. The image forming method according to claim 25, wherein the electrostatic image is a digital electrostatic image and is developed with the two-component developer according to reversal development mode while applying an AC bias voltage to the developer carrying member.

27. The image forming method according to claim 25, wherein the toner has a negative chargeability relative to the magnetic carrier.

28. The image forming method according to claim 27, wherein the toner has a negative chargeability of −20 to −100 μC/g relative to the magnetic carrier.

29. The image forming method according to claim 27, wherein the toner has a negative chargeability of −30 to −60 μC/g relative to the magnetic carrier.

30. The image forming method according to claim 27, wherein the toner has a weight-average particle size of at most 9.0 μm, and the magnetic carrier has an average particle size of 20–100 μm.

31. The image forming method according to claim 27, wherein the toner has a weight-average particle size of 3.0–8.0 μm, and the magnetic carrier has an average particle size of 30–65 μm.

* * * * *

UNITED STATES PATENT AND TRADEMARK OFFICE

CERTIFICATE OF CORRECTION

PATENT NO. : 6,001,525

DATED : December 14, 1999

INVENTOR(S) : TETSUYA IDA ET AL.

It is certified that error appears in the above-identified patent and that said Letters Patent is hereby corrected as shown below:

ON THE TITLE PAGE

[57] ABSTRACT:

Line 4, "wherein" should read --under--.

COLUMN 1:

Line 56, "comprises" should read --comprise--.

COLUMN 2:

Line 9, "ferromagnetic," should read --ferromagnetic material,--; and
Line 57, "performances" should read --performance--.

COLUMN 6:

Line 5, "and" should be deleted.

COLUMN 9:

Line 39, "product. Pulverization" should read --product, and pulverization--;
Line 49, "container" should read --contain--; and
Line 54, "20-100 $\mu$C/g." should read --20-100 $\mu$C/g,--.

COLUMN 11:

Line 55, "an ununiform" should read --a nonuniform--; and
Line 64, "as" should be deleted.

UNITED STATES PATENT AND TRADEMARK OFFICE

CERTIFICATE OF CORRECTION

PATENT NO. : 6,001,525

DATED : December 14, 1999

INVENTOR(S) : TETSUYA IDA ET AL.

It is certified that error appears in the above-identified patent and that said Letters Patent is hereby corrected as shown below:

COLUMN 12:

Line 2, "layer" should read --larger--; and
Line 48, "about" should be deleted.

COLUMN 13:

Line 36, "glipper" should read --gripper--; and
Line 63, "glipper" should read --gripper--.

COLUMN 14:

Line 5, "once" should read --first--.

COLUMN 19:

Line 41, "Ununiform" should read --Nonuniform--;
Line 58, "time by hands" should read --times by hand--; and
Line 62, "a" should read --to a--.

COLUMN 21:

Line 17, "weight" should read --weighed--;
Line 18, "spirator" should read --aspirator--;
Line 32, "$(CxV)/(W_1=W_2)$" should read --$(CxV)/(W_1-W_2)$--; and
Line 50, "was" should read --were--.

COLUMN 22:

Line 30, "each" should read --each of--; and
Line 44, "EXAMPLES 5-6" should read --EXAMPLES 5-6,--.

UNITED STATES PATENT AND TRADEMARK OFFICE

CERTIFICATE OF CORRECTION

PATENT NO. : 6,001,525

DATED : December 14, 1999

INVENTOR(S) : TETSUYA IDA ET AL.

It is certified that error appears in the above-identified patent and that said Letters Patent is hereby corrected as shown below:

COLUMN 25:

Line 3, "compositions" should read --composition--.

COLUMN 29:

Table 8, "A B" should read --A B
B A B--;

COLUMN 31:

Line 14, "group." should read --groups.--.

Signed and Sealed this

Thirtieth Day of January, 2001

*Attest:*

Q. TODD DICKINSON

*Attesting Officer*

*Director of Patents and Trademarks*